US006733097B2

(12) United States Patent
Kim et al.

(10) Patent No.: US 6,733,097 B2
(45) Date of Patent: May 11, 2004

(54) SELF-CLOSING SLIDE AND MECHANISM FOR A SELF-CLOSING SLIDE

(75) Inventors: Jae Kim, Cerritos, CA (US); Charles A. Milligan, Seal Beach, CA (US); Ricardo Leon, Buena Park, CA (US)

(73) Assignee: Accuride International, Inc., Santa Fe Springs, CA (US)

( * ) Notice: Subject to any disclaimer, the term of this patent is extended or adjusted under 35 U.S.C. 154(b) by 0 days.

(21) Appl. No.: 09/846,765

(22) Filed: Apr. 30, 2001

(65) Prior Publication Data

US 2002/0011766 A1 Jan. 31, 2002

Related U.S. Application Data

(60) Provisional application No. 60/202,365, filed on May 1, 2000.

(51) Int. Cl.[7] ..... A47B 88/04

(52) U.S. Cl. ..... 312/333; 312/319.1

(58) Field of Search ..... 312/319.1, 330.1, 312/333, 334.1, 334.7, 334.8, 334.11, 334.16, 334.44, 350; 384/20, 21

(56) References Cited

U.S. PATENT DOCUMENTS

| | | | |
|---|---|---|---|
| 930,534 | A | 8/1909 | Cox |
| 3,104,142 | A | 9/1963 | Knape et al. |
| 3,139,313 | A | 6/1964 | Rule |
| 3,243,247 | A | 3/1966 | Knape |
| 3,506,292 | A | 4/1970 | Hagendoorn et al. |
| 3,574,437 | A | 4/1971 | Stein et al. |
| 3,666,342 | A | 5/1972 | Biesecker |
| 3,697,140 | A | 10/1972 | Livingston |
| 3,700,301 | A | 10/1972 | Boeck |
| 3,713,681 | A | 1/1973 | Worley |
| 3,716,279 | A | 2/1973 | Anderson et al. |
| 3,954,315 | A | 5/1976 | Sanden |
| 3,973,814 | A | 8/1976 | Entrikin |
| 4,006,951 | A | 2/1977 | Geer et al. |
| 4,116,512 | A | 9/1978 | Wiser |
| 4,138,174 | A | 2/1979 | Cox et al. |
| 4,155,610 | A | 5/1979 | Englund |
| 4,159,153 | A | 6/1979 | Yoshikawa |
| 4,423,914 | A | 1/1984 | Vander Ley |
| 4,494,806 | A | 1/1985 | Williams et al. |
| 2002/0033658 | A1 | 3/2002 | Salice |
| 4,501,455 | A | 2/1985 | Groseck |
| 4,600,255 | A | 7/1986 | Dubarko |
| 4,615,095 | A | 10/1986 | Bessinger et al. |

(List continued on next page.)

FOREIGN PATENT DOCUMENTS

| | | | | |
|---|---|---|---|---|
| DE | 4124512 | | 2/1992 | |
| DE | 9114787 | | 2/1992 | |
| DE | 297 01 895.7 | | 3/1997 | |
| EP | 0 386 731 | B1 | 9/1990 | |
| EP | 391221 | * | 10/1990 | ..... 312/333 |
| EP | 0 529 679 | B1 | 3/1993 | |
| EP | 0 552 500 | A1 | 7/1993 | |
| JP | 405317133 | A | 12/1993 | |

OTHER PUBLICATIONS

Shelby Furniture brochure "Drawer slides", Mar. 2001, 3 pages.*

FR 5000 Full–Extension Ballbearing Drawerslide, Fulterer, p. 39, no date given.

*Primary Examiner*—James O. Hansen

(74) *Attorney, Agent, or Firm*—Christie, Parker & Hale, LLP

(57) ABSTRACT

A mechanism is provided that couples to a slide member of at least a two member slide forming a self-closing slide. The mechanism comprises a housing having a slot guiding an actuator. The actuator is spring coupled to the housing. The actuator engages a second slide member of the slide when the second slide member approaches a closed position. The spring generates a force for moving the actuator and the engaged second slide along the slot to a slide closed position.

32 Claims, 17 Drawing Sheets

U.S. PATENT DOCUMENTS 4,653,820 A 3/1987 Tazaki
4,679,950 A 7/1987 Delmege et al.
4,811,579 A 3/1989 Lyons et al.
4,872,734 A 10/1989 Rechberg
5,015,048 A 5/1991 Brunnert
5,020,868 A 6/1991 Brunnert
5,033,805 A 7/1991 Hobbs
5,040,833 A 8/1991 Brunnert ..... 292/80
5,040,858 A 8/1991 Kruse et al.
5,056,879 A 10/1991 Röck et al.
5,207,781 A 5/1993 Rö ck
5,226,716 A 7/1993 Geil
5,232,278 A 8/1993 O'Brien et al.
5,240,318 A 8/1993 Schroder et al. ..... 312/319.1
5,255,983 A 10/1993 Parvin
5,302,016 A 4/1994 Lautenschlä ger et al. ..... 312/333
5,312,180 A 5/1994 Tieder et al.
5,364,179 A 11/1994 Brü stle et al. ..... 312/333
5,388,902 A 2/1995 Huebschen et al.
5,421,481 A 6/1995 Fortmann et al.
5,474,375 A 12/1995 Hollenstein et al. ..... 312/319.1
5,484,209 A 1/1996 Weng
5,520,452 A 5/1996 Petersen et al.
5,542,759 A 8/1996 Krivec
5,580,138 A 12/1996 Grabher ..... 312/319.1
5,671,988 A 9/1997 O'Neill
5,671,989 A 9/1997 Lautenschläger
5,730,514 A 3/1998 Hashemi
5,733,027 A * 3/1998 Lautenschlager ..... 312/334.12
5,909,935 A 6/1999 Esperandieu et al.
5,944,396 A 8/1999 Stephan
5,961,193 A 10/1999 Hobbs
5,975,662 A 11/1999 Weber ..... 312/319.1
6,254,205 B1 7/2001 Wright et al.
6,340,078 B1 1/2002 Scheible
6,412,891 B1 7/2002 Liang et al.
2002/0011766 A1 1/2002 Kim et al.

* cited by examiner

SELF-CLOSING SLIDE AND MECHANISM FOR A SELF-CLOSING SLIDE

CROSS-REFERENCE RELATED APPLICATION

This application is based upon and claims priority on U.S. provisional application No. 60/202,365, filed May 1, 2000, the contents of which are fully incorporated herein by reference.

BACKGROUND OF THE INVENTION

The present invention is directed to a self-closing slide and mechanism for a self-closing slide.

Drawers are typically coupled to cabinets using slides. These slides are typically two-member slides or three-member slides. A two-member slide comprises an outer member and an inner member. The inner member is slidably coupled to the outer member and can telescope relative to the outer member. A three-member slide comprises three members, namely, an outer member, an intermediate member, and an inner member. The intermediate member is slidably coupled to the outer member and the inner member is slidably coupled to the intermediate member. Both the intermediate and inner member telescope relative to the outer member. Moreover, the inner member can telescope relative to the intermediate member. Typically the slide outer members are coupled to the cabinet and their inner members are coupled to either side of the drawer.

The problem with many drawers is that they tend to open after they are closed. Another problem with drawers is that when they are pushed to close, they sometimes do not close completely because they are not pushed with sufficient force or alternatively they are pushed with more force than necessary causing the drawers to slam against the cabinet and then re-open.

To overcome these problems some slides incorporate self-closing mechanisms that use an extension spring coupled to the outer member of the slide. The spring engages a tab or pin welded or otherwise fixed to the inner member of the slide to pull the inner member toward the outer member and close the slide. The problem with these mechanisms is that the spring is in an extended or stretched position until it is engaged by the tab or pin fixed to the inner member. As such, the spring remains stretched until the slide closes. Consequently, if the spring breaks while stretched - - - which a common failure mode for extension springs - - - it will have a tendency to eject from the mechanism creating a hazardous condition. Moreover, the tabs tend to break off from the inner member with usage due to fatigue causing early failure of the self-closing mechanism.

Consequently, a mechanism is desired for use in slides that will keep the slides in a closed position when the slides are fully closed, that will also help the slide self-close as they reach close to the end of their rearward travel and which are not subject to the early failures and hazardous conditions created by currently available slide self-closing mechanisms.

SUMMARY OF THE INVENTION

A mechanism is provided that couples to a first slide member of at least a two member slide. The mechanism comprises a housing having a slot guiding an actuator. The actuator is spring coupled to the housing. The actuator can slide along the slot between a first position and a second position. The actuator can remain engaged in the first position with the spring armed. When a second member of the slide approaches a closed position, it is engaged by the actuator. As the second member continues to move toward a closed position it causes the actuator to disengage from the first position whereby the armed spring causes the actuator and the engaged second slide member to slide along the slot to the second position where the slide is closed.

When the second slide member is extended relative to the first slide member, it causes the actuator to move from the second position toward the first position. When in the first position, the spring rearms and the actuator gets engaged in the first position, while the second slide member disengages from the actuator.

DETAILED DESCRIPTION OF THE INVENTION

Self-closing mechanisms are provided that attach to slide members of slides at or proximate the members' rearmost ends. Consequently, slides incorporating such mechanisms become self-closing slides. For convenience, the mechanisms are described herein in relation to a three-member slide. However, the mechanisms can be incorporated into two member slides or other slides using multiple sliding members.

Figure 1:
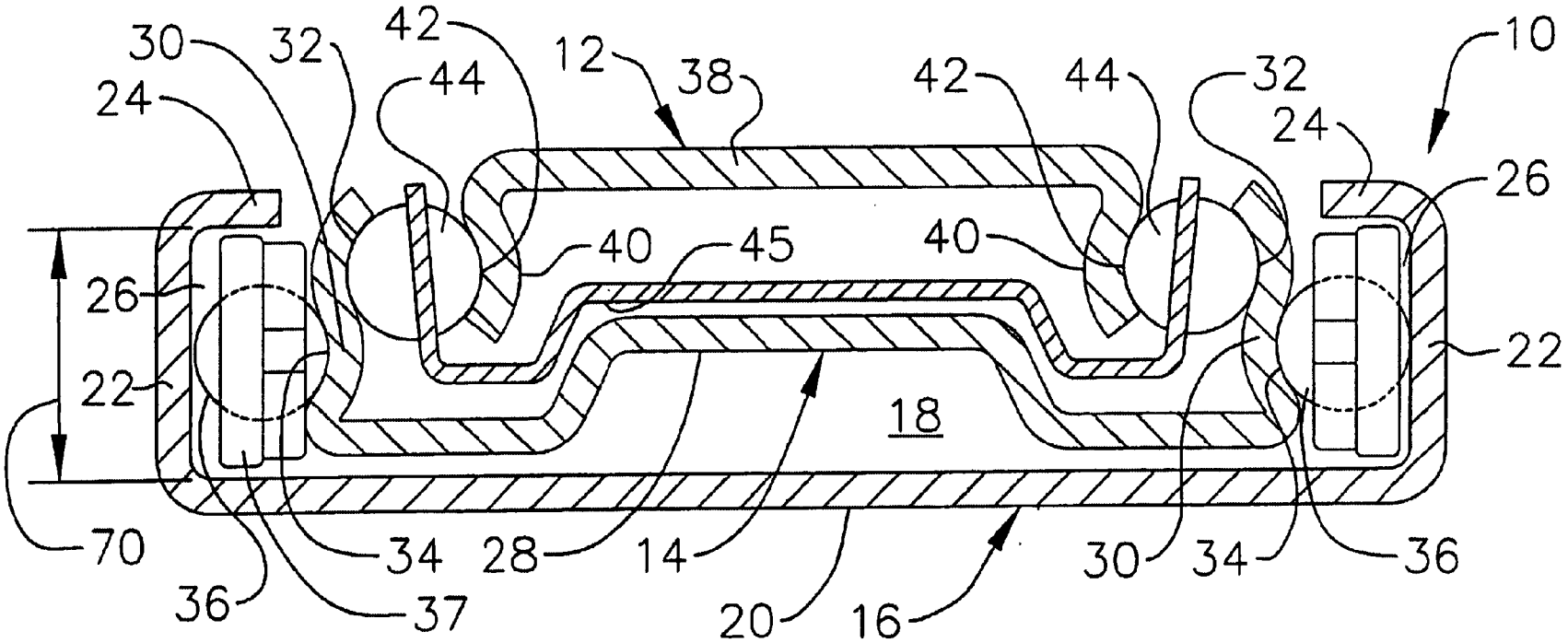
FIG. 1 (PRIOR ART)
FIG. 1 is a cross-sectional view of a three-member slide.

A typical three member slide 10 comprises an inner member 12 slidably coupled to an intermediate member 14 which is slidably coupled to an outer member 16 (FIG. 1). The outer member is channel shaped in cross section, i.e., it defines a channel 18, having web 20 and two legs 22 extending preferably perpendicularly from opposite ends of the web. A lip 24 extends preferably perpendicularly from each leg such that the two lips extend toward each other. A bearing raceway 26 is defined by each lip, its corresponding leg and the web. The intermediate slide member 14, also generally channel shaped in cross-section, is slidably coupled within the outer member 16.

In cross-section, the intermediate member also comprises a web 28 and two legs 30 extending from opposite ends of the web. Each of the legs has a double curvature such that each leg defines an inner raceway 32 and an outer raceway 34. The intermediate member is slidably coupled within the outer member with their "channels" facing in the same direction. Ball bearings 36 are sandwiched between the inner bearing raceways 26 of the outer member and the outer bearing raceways 34 of the intermediate member. The ball bearing are typically coupled to an outer ball bearing retainer 37.

The inner member is also channel shaped in cross-section comprising a web 38 having two legs 40 extending from opposite ends of the web. A concavity is formed on the outer surface of each leg defining an outer bearing raceway 42. The inner member is slidably coupled to the intermediate member with the channel of the inner member facing opposite the channel of the intermediate member. In other words, the legs of the inner member extend from the web 38 of the inner member toward the web 28 of the intermediate member. Ball bearings 44 are sandwiched between the outer bearing raceways 42 of the inner member and the inner bearing raceways 32 of the intermediate member. The ball bearing are typically coupled to an inner ball bearing retainer 45. Each slide member is typically formed from a single piece of material.

Figure 2A:
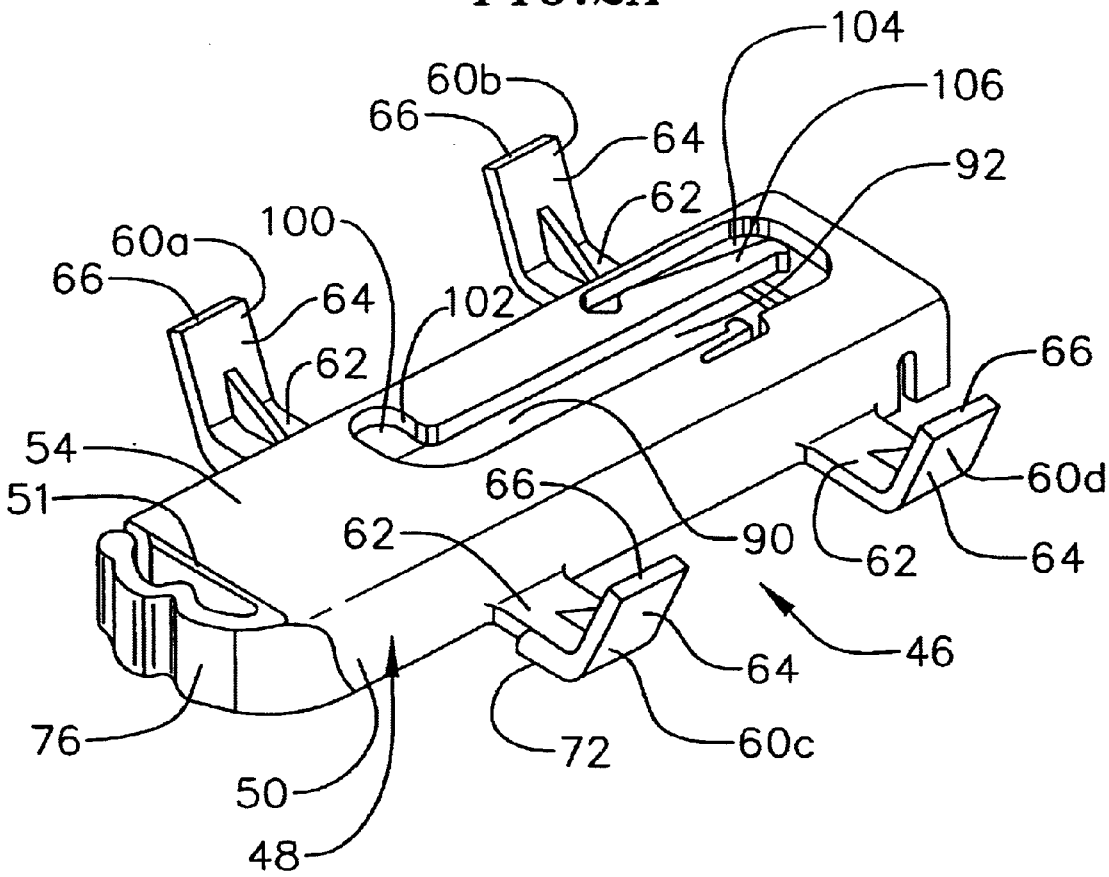
FIGS. 2A and 2B are a perspective and side view, respectively, of the housing of an exemplary embodiment self-closing mechanism of the present invention.
Figure 3:
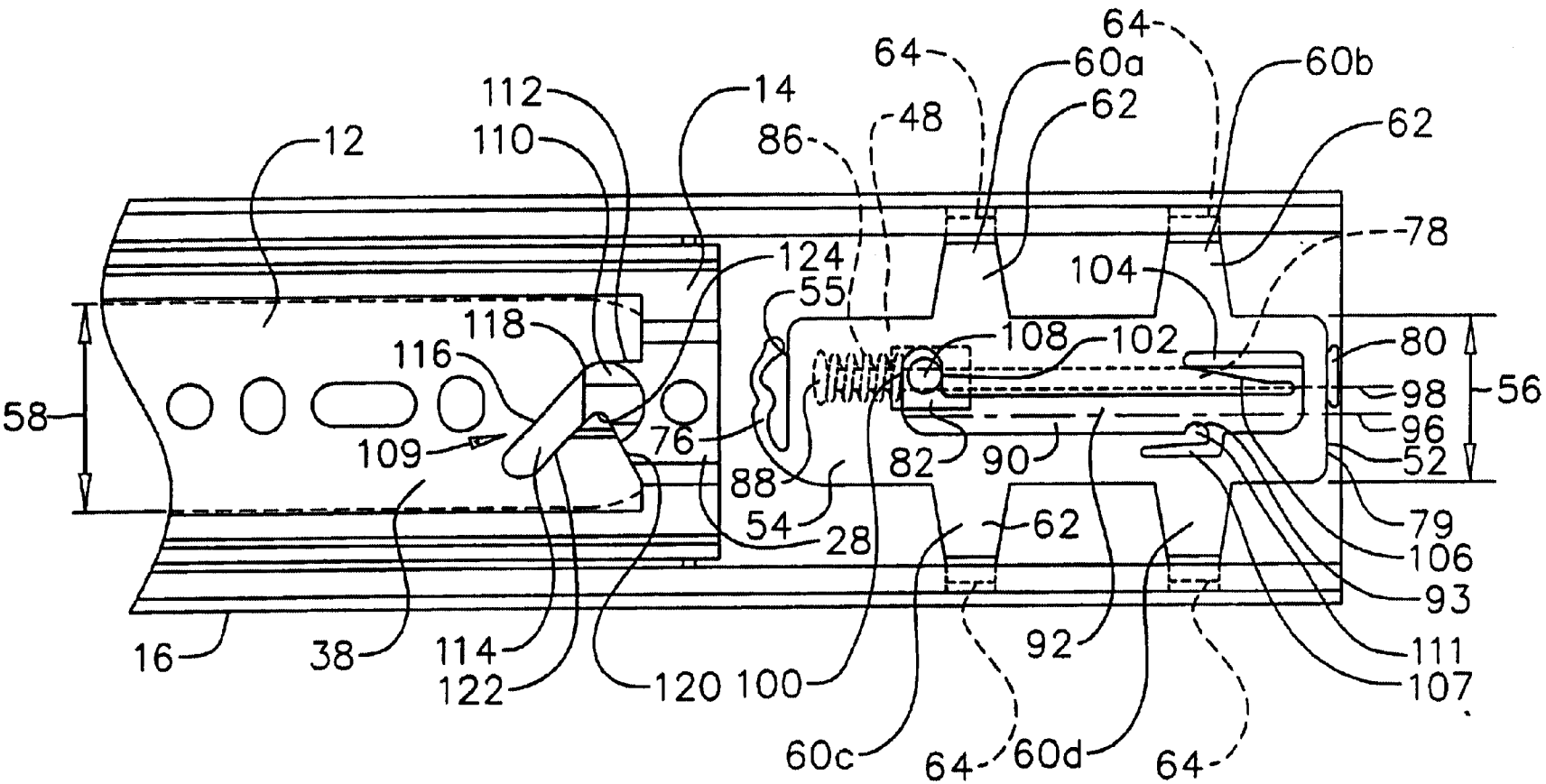
FIG. 3 is a partial top view of an exemplary embodiment three-member self-closing slide incorporating an exemplary embodiment self-closing mechanism of the present invention.

An exemplary embodiment self closing mechanism 46 of an embodiment of the present invention comprises an elongated housing or body 48 having opposing side walls 50, an rear wall 52 and top wall 54 (FIGS. 2A and 3). The housing may also have a front wall 55. The width 56 of the top wall, i.e., the spacing between the side walls, is smaller than the width 58 of the slide inner member web 38. In this regard, the inner member can slide over the housing. The housing may also have a base or bottom wall (not shown). The terms, "upper," "lower," "top," bottom," "base," "upward," "downward," "forward," "rear," "front" and "back" are used as relative terms and are not meant to denote the exact location of a member operated by such term.

Figure 2B:
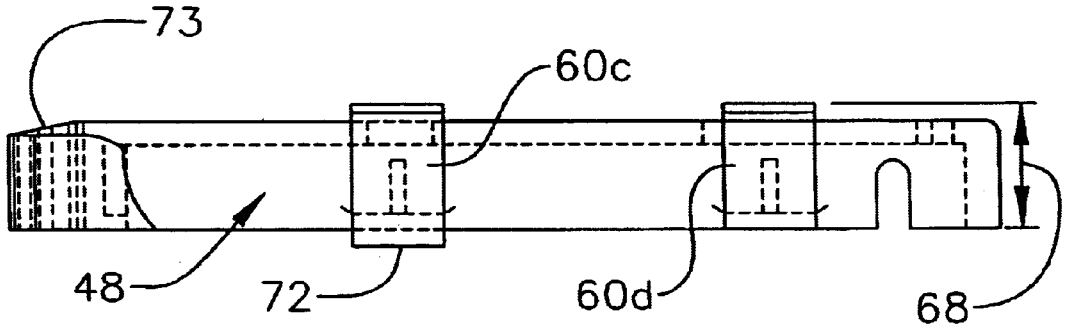

Two, but preferably four legs 60*a,* 60*b,* 60*c,* 60*d* extend transversely from the base portion of the housing sides 50 In a preferred embodiment two legs extend from either side of the housing from proximate the base of the sides. Each leg comprises a first portion 62 extending laterally from a side wall 50 of the housing. Each of the legs also comprise a second portion 64 extending from the first portion inclined at an angle relative to the first portion such that the free-end 66 of the second portion is higher than the first portion. The second portions have a height 68 as measured perpendicularly to the first portion that is preferably slightly smaller than an inner height 70 of the inner bearing raceway of the outer member (FIGS. 1 and 2B). The housing and legs are preferably integrally formed and are preferably made of plastic. In this regard, the legs are flexible allowing for the housing to be "snapped-in" place on the slide outer member.

Figure 4:
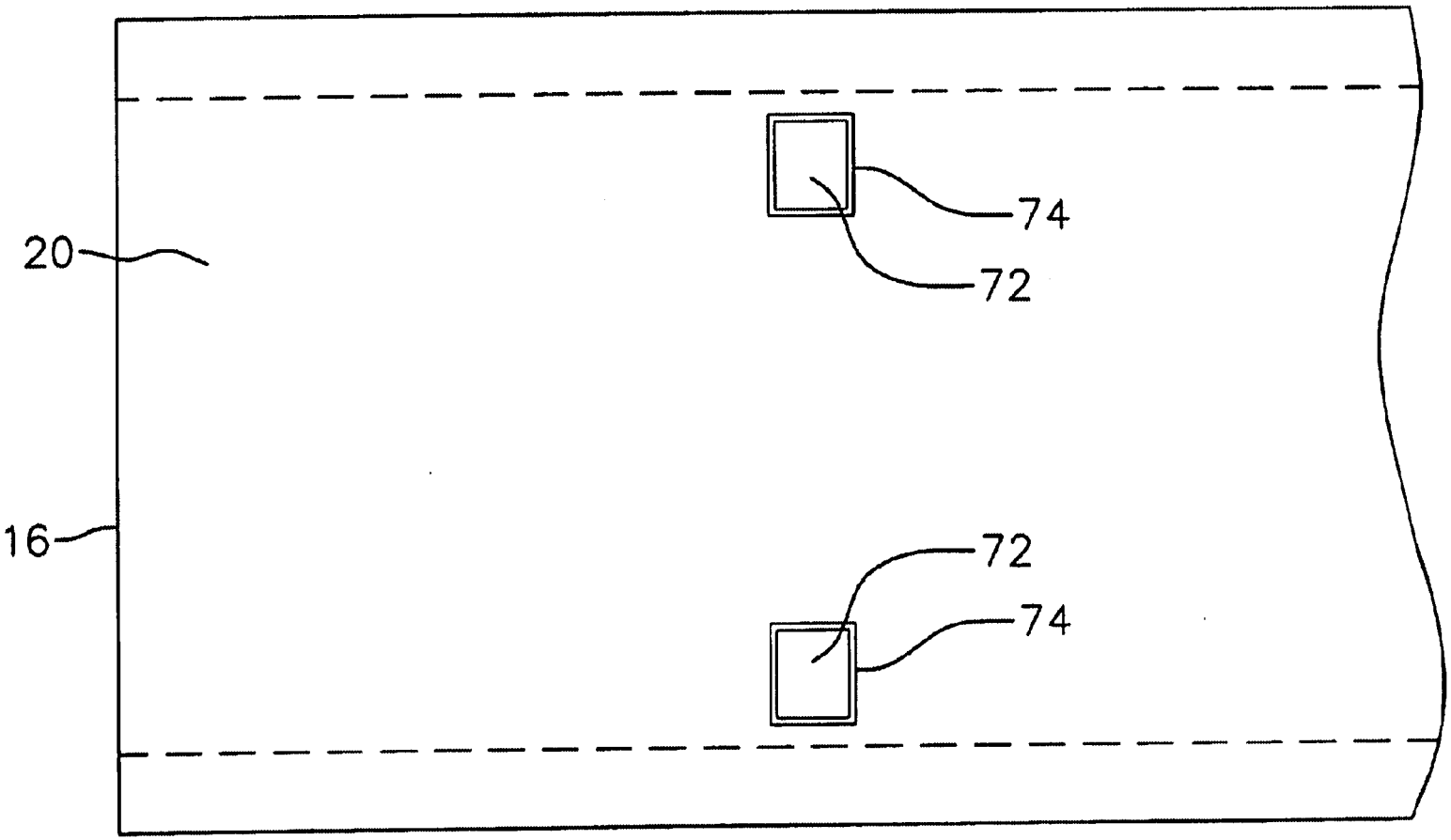
FIG. 4 is a partial bottom view of the self-closing slide shown in FIG. 3.

The housing with legs is mounted within the outer slide channel at the rearmost end portion as shown in FIG. 3. Specifically, the housing with legs is slid or "snapped-in" within the channel defined by the outer slide such that the free ends 66 of the leg second portions engage the inner surfaces of lip portions 24 of the outer slide. Consequently, the leg second portions which occupy the height 70 of almost the entire inner bearing raceway fit tightly within the inner bearing raceways 26 of the outer member. In an exemplary embodiment, a protrusion 72 is formed extending from the bottom surface of the first portion of at least one leg but preferably extending from the bottom surfaces of at least two oppositely extending legs, as for example legs 60*a* and 60*c* (FIGS. 2A and 2B). Complementary slots 74 are formed through the web 20 of the outer slide member 16 such that when the legs are urged toward the web 20, the protrusions 72 enter their complementary slots 74 thereby providing a more secure engagement between the housing and the slide outer member (FIG. 4).

When the housing is attached to the outer slide member, it is in the sliding path of the slide intermediate member 14, as for example shown in FIG. 3. To accommodate for the length of the outer member occupied by the housing, the intermediate member preferably has a length shorter than outer member 16 so that when it is in the fully retracted position relative to the outer member, the intermediate member does not extend beyond the outer member.

When the mechanism is incorporated in a three-member slide, a stop member may extend from the front portion of the housing for stopping the travel of the intermediate member and silence an impact of the intermediate member on the housing. The stop member may be resilient material mounted on the front portion of the housing. In a preferred exemplary embodiment, the stop member is a flexing arm 76 integrally formed with the housing 48 and extending from one side of the housing transversely to proximate the other side of the housing. When the web 28 of the intermediate member strikes the flexing arm 76, the arm flexes toward the housing to soften and silence the impact while providing a stop to the rearward travel of the intermediate member. Preferably the stop member is shorter in height than the housing and the upper surface 73 of the front portion of the housing is tapered so as to increase in height in a direction toward the rear of the housing as for example shown in FIG. 2B. In this regard, if the inner slide member were to contact the tapered upper surface 73 as it slides toward a closed position, it would ramp up and over the housing.

A guide rod also referred to herein for convenience as a "guide pin" or "pin" 78 is coupled to the rear wall 52 of the housing and extends within the housing as shown in FIG. 3. The guide pin in the exemplary embodiment shown in FIG. 3 and described herein is cylindrical, i.e., it has a circular cross-sectional shape. However, the pin may have other cross-sectional shapes.

The pin is coupled to the rear wall of the housing slightly nearer one of the side walls 50 and is capable of pivoting relative to the rear wall. Pivoting can be accomplished by providing an opening through the rear wall 52 having a diameter much larger than the guide pin 78 diameter. An end of the pin protrudes through the rear wall opening and is capped forming a rear cap 80 having a larger diameter than the opening. In this regard, the capped end is prevented from re-entering the housing and the pin is able to move sideways within the opening and thereby allowing the guide pin to pivot relative to the rear wall. In an alternate embodiment, the guide pin is allowed to exit the housing through a rear wall opening and is then bent such that the bent portion of the pin engages the outer surface 79 of the rear wall 52 preventing the pin from retracting back into the housing.

Figure 5A:
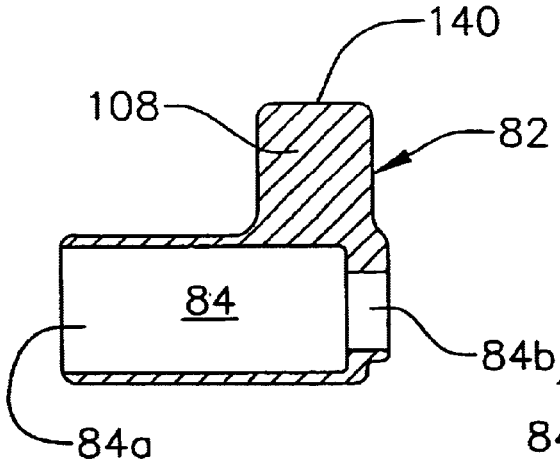
FIGS. 5A and 5B are a cross-sectional and a perspective view, respectively, of an actuator used in the self-closing mechanism shown in FIG. 2A.
Figure 5B:
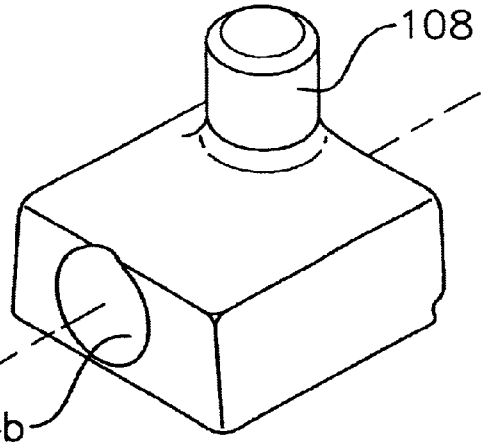

An actuator 82 is slidably coupled to the guide pin 78 such that it can slide along the guide pin length (FIGS. 3 and 5A). Typically, the actuator comprises an opening 84 that is penetrated by the pin, thus, allowing the actuator to slide along the pin. Preferably the opening 84 is a sectioned opening having a first larger diameter section 84*a* and a second smaller diameter section 84*b*. A spring 86 is placed over the pin for urging the actuator toward the rear wall 52 of the housing. The spring has an outer surface diameter larger than the diameter of the actuator opening smaller diameter section 84*b* and smaller than the diameter of the actuator opening larger diameter section 84*a*. The pin is capped at its front end forming a front cap 88 or is bent so as to retain the spring over the guide pin. The guide pin 78, spring 86 and actuator 82 are all housed within the housing 46 and can all pivot with the pin relative to the rear wall of the housing.

A slot 90 is formed through the top wall of the housing. The slot has a major longitudinal portion 92 having a central longitudinal axis 96 which is preferably offset in parallel from a central longitudinal axis 98 of the housing. The slot longitudinal portion extends from preferably proximate the rear wall of the housing toward the front wall 55. A transverse portion 100 of the slot extends transversely from the forward end of the slot longitudinal portion in a direction crossing the central longitudinal axis 98 of the housing. The rear most edge of the transverse portion of the slot defines a transverse edge 102.

A longitudinal slit 104 is formed on the top wall proximate the rear wall and offset form the slot longitudinal portion 92. The slit is shorter than the slot and it is in communication with the slot at its rearmost end. Consequently, a flexible tine 106 is defined between the slot and the slit.

In a preferred exemplary embodiment, a second slit 107 is formed on the edge of the slot longitudinal portion 92 opposite the tine 106 and proximate the rear end of the slot longitudinal portion. The second slit defines a flexible detent 111 which extends into the path of the slot longitudinal portion 92. The detent may have a protrusion 93 extending into the slot longitudinal portion.

A guide member 108 extends from an upper surface of the actuator and is fitted within the slot 90 (FIGS. 3 and 5A). In one exemplary embodiment, shown in FIGS. 3 and 5A, the guide member is in the form of a pin 140. The guide member and actuator are preferably integrally formed. The slot 90 serves to guide the guide member and thereby the actuator travel along the housing. As the actuator travels along the housing, the guide pin 78 pivots relative to the housing rear wall 52 to accommodate the actuator travel. When in the rear end of the slot, the pin and thus the actuator can move laterally against the tine 106, flexing the tine.

As the actuator is moved forward along the slot 90, it compresses the spring 86 against the guide pin front cap 88. When at the front end of the slot, the actuator guide follows the curved portion of the slot and into the transverse portion 100 of the slot as the guide pin 78 is pivoted about the rear wall. When at that position, the spring is compressed providing a force attempting to urge the actuator in a direction toward the rear wall. The force causes the actuator guide member to engage the transverse edge 102 defined by the transverse slot portion on the housing top wall and thereby maintain the actuator within the transverse slot portion in an "armed" state. The transverse edge 102 is of sufficient length to support the actuator guide member 108. When the guide member is moved transversely toward the longitudinal portion of the slot, the spring force causes the actuator to move along the slot to rear end of the slot.

Figure 6A:
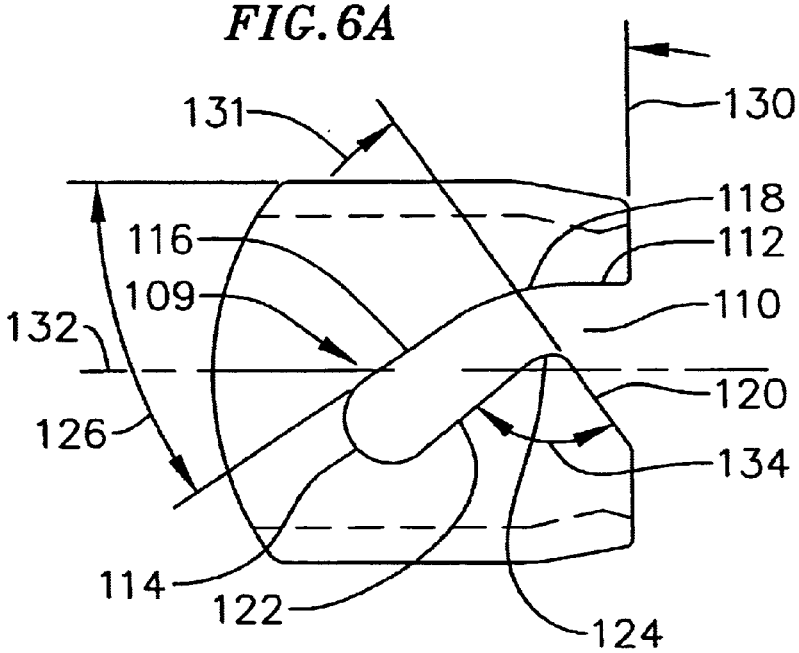
FIGS. 6A and 6B are an enlarged section top view and an end view, respectively, of the inner slide member of the self-closing slide shown in FIG. 3.

A web slot 109 is formed on the rear end of the web 38 of the inner slide member 12. The slot has a short first portion 110 longitudinally extending from the rear end of the inner member web 38 (FIGS. 3 and 6A). The first portion of the web slot is aligned to straddle the guide member of the actuator as the inner member is slid over the housing. The web slot first portion has a first longitudinal edge 112 positioned furthest from the longitudinal slot on the housing top wall. The web slot than curves in a direction toward the longitudinal slot of the top wall and forms a second inclined slot portion 114. The second slot portion has a first edge 116 inclined to the first edge 112 of the slot first longitudinal portion at an angle preferably less than 90°. A curved edge 118 forms the transition between the first edges of the first and second slot portions.

The second edge 120 of the first slot portion 110 opposite the first longitudinal edge 112 extends away from the first longitudinal edge to the rear end of the inner member web. The second edge 120 of the first web slot portion extends transversely to at least a location axially aligned with the longitudinal portion 92 of the slot formed on the housing top wall. Preferably, the second edge 120 spans a distance sufficient for engaging the actuator guide member when the actuator guide member is located within the longitudinal portion 92 of the slot formed on the housing top wall. More preferably, the second edge 120 spans transversely to a distance covering the entire width of the longitudinal portion 92 of the housing top wall slot.

A second edge 122 of the web second slot portion 114 opposite the inclined first edge 116 is inclined at an angle to the second edge 120 of the first slot portion and extends in a direction similar to the first edge 116 of the second web slot portion. The point of intersection between second edge of the first slot portion and the second edge of the second slot portion is preferably rounded forming a tip 124.

As the inner member of the slide is retracted rearward toward a closed position, the guide member of the actuator enters the first portion 110 of the web slot 109. As the inner member continues to move rearward, the actuator guide member 108 makes contact with the curved edge 118 of the web slot and then the first edge 116 of the second slot portion. When that occurs and as the inner member further retracts, the actuator guide member is guided transversely by the first edge 116 of the web slot second portion along the web slot second portion 114. This causes the actuator guide member and thus the actuator to move transversely along the transverse portion 100 of the slot on the housing top wall and to the longitudinal portion 92 of the top wall slot. When that occurs, the spring "unarms" and the spring force causes the actuator to travel rearwards along the guide pin and the actuator guide member to travel rearward along the longitudinal portion 92 of the slot formed on the housing top wall. As the actuator guide member is moved rearwardly by the spring force, it engages and applies a force on the second edge 122 of the second slot portion 114 of the web slot causing the inner member to slide rearwardly with the guide member and the slide to self close.

As the slide inner member is extended after being closed, the second edge 122 of the web slot second portion 114 applies a force on the actuator guide member causing the guide member to move forward along the longitudinal portion 92 of the slot on the housing top wall and against the spring force compressing the spring 86. When the actuator guide member reaches the front end of the longitudinal portion 92 of the top wall slot its longitudinal motion is stopped as the inner slide member continues to extend. Consequently, the actuator guide member begins to move rearwardly relative to the web slot 109 and along the second edge 122 of the second portion of the web slot 109. Thus, the actuator guide member is moved transversely relative to the housing and along the transverse portion 100 of the top wall slot where it engages the transverse edge 102 on the housing top wall as a result of the applied spring force. As the inner member is further extended the guide member exits the web slot 109 and remains "armed" against the transverse edge 102.

When the actuator is in the rearmost position, e.g. when the slide is in a closed position, the spring 86, which is in the exemplary embodiment is a compression spring, is in its normal extended position offering minimal or no force. In the exemplary embodiment shown in FIG. 3, the detent 111 controls any bouncing of the slide and actuator that may occur. If the slide with actuator attempt to re-extend, i.e., "bounce", from the closed position, the detent 111 which extends into the path of the slot longitudinal portion 92 formed on the housing top wall will engage the actuator guide member and stop the re-extending travel i.e., the bounce.

If the actuator guide member inadvertently disengages from the transverse edge 102 of the slot formed on the housing top wall and moves to the rear end of the housing by the spring force, the self closing mechanism can be re-engaged by the inner slide member. This is accomplished by retracting the inner slide member. As the inner slide member is retracted, the second edge 120 of the inner member web slot first portion engages the actuator guide member 108. As the inner member is further retracted, the actuator guide member is caused to move transversely along the second edge 120 causing the guide member to engage and flex the tine 106 on the housing and move it transversely. When flexed, the tine provides a force against the actuator guide member 108 tending to push the guide member toward the longitudinal slot portion. As the inner slide member continues to retract, the actuator guide member reaches and passes the tip 124 of the web slot at which point the force generated by the tine causes the actuator guide member to move into the second slot portion 114 of the web slot 109. Once within the second slot portion 114, the actuator guide member is engaged by the inner slide member and extension of the slide member will cause the actuator guide member and the actuator to move into an "armed" position as discussed above.

Applicants have discovered that an incline angle 126 (FIG. 6A) of 34° between the first edge 116 of the web slot second portion and the first longitudinal edge 112 of the first longitudinal portion of the web slot to be optimum for the operation of the mechanism when the guide member 108 is cylindrical. A shallower angle may provide for smoother operation of the mechanism, but with such angle a longer second slot portion is required for moving the actuator guide member a sufficient transverse distance for disengaging from the transverse edge 102 of the transverse portion 100 of the slot formed on the housing top wall.

Applicants have also discovered that for optimum operation, the second edge 120 of the first web slot portion 110 should extend at angle 131 preferably of about 350 from an axis 130 perpendicular to the inner member web longitudinal axis 132 located at the rear end of the web. In addition, applicants have discovered that the second edge 122 of the second web slot portion should be inclined at an angle 134 of about 95° to the second edge 120 of the first slot portion. Furthermore, applicants have discovered that the tip 124 between second edge of the first slot portion and the second edge of the second slot portion should be rounded to allow for smooth re-engagement of the actuator guide member if it inadvertently disengages from the slide inner member. An exemplary radius for the tip is about 0.08 inch. Moreover, applicants have discovered that a spring 86 with a spring rate 1.2 lbs. per inch or capable of providing a force of 3 lbs. provides sufficient force for self-closing of a slide coupled to a typical kitchen drawer and cabinet.

Figure 6B:
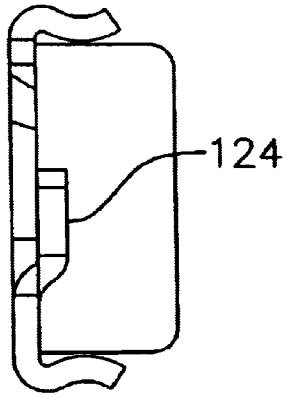

In a preferred embodiment, the tip 124 formed on the web slot is joggled so as to engage the actuator guide member 108 along a lower location closer to the upper surface of the housing top wall as shown for example in FIG. 6B. In this regard, the force applied by the tip 124 to the actuator guide member is reacted more in shear, and less in moment, tending to move the actuator guide member and actuator. By applying a smaller moment to the actuator guide member, more of the force applied to the actuator guide member is used to move the actuator. Consequently, a lesser force is needed to move the actuator and the motion of the actuator is smoother.

In the exemplary embodiment shown in FIG. 3, the housing has a length of about 2.465 inches; the longitudinal slot extends to a length of about 1.6 inches along the housing top wall; the inner slide member web has a width of about 0.76 inch at the rear end of the inner member; the second slot portion extends a distance of about 0.694 inch into the inner slide member web as measured from the rear end of the web; the first edge of the first inner slide member web slot portion is located at about 0.698 inch from the outer surface of the furthest leg of the inner slide member; and the rounded tip is located at about 0.519 inch from the outer surface of the furthest leg of the inner slide member.

Figure 7A:
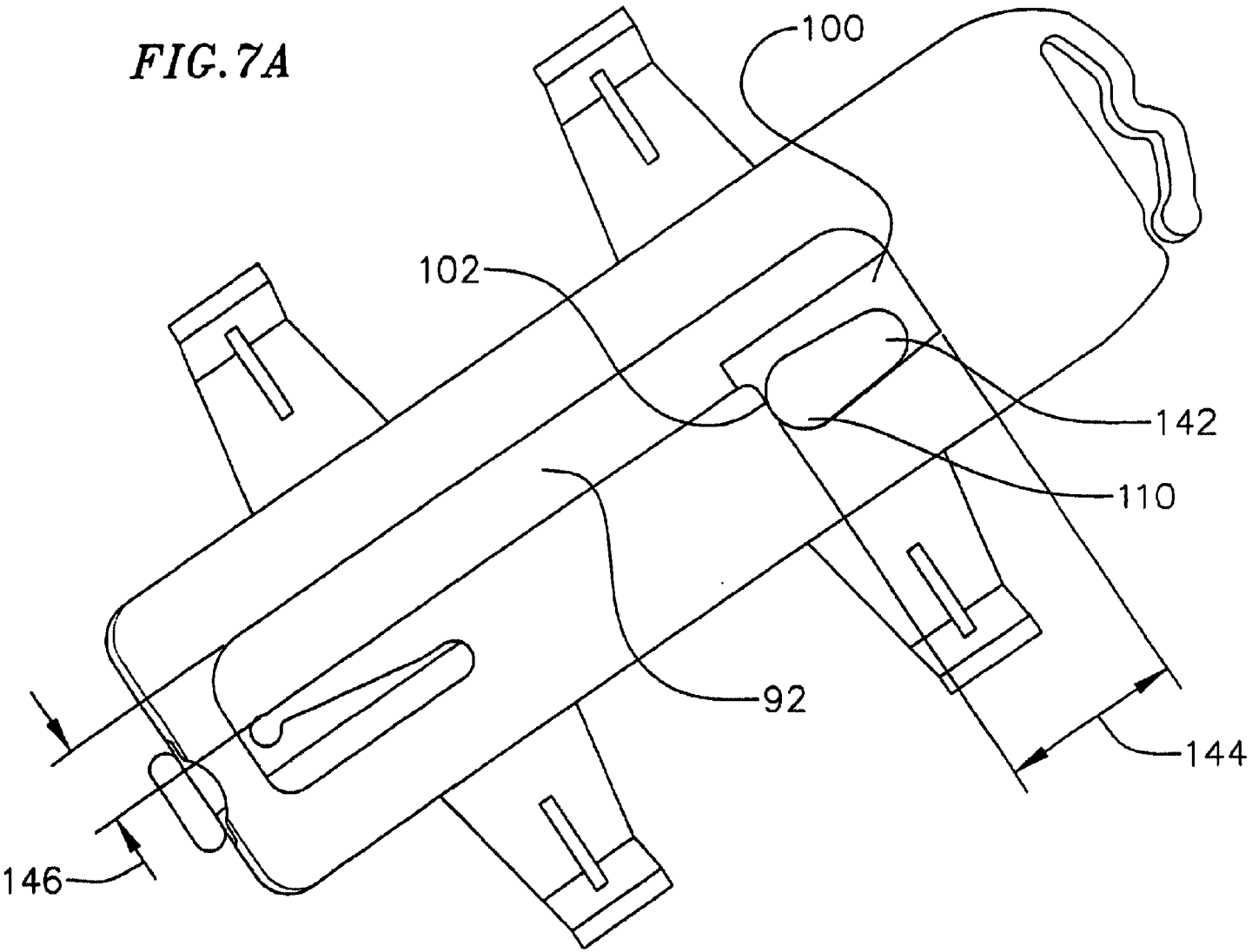
FIG. 7A is a top view of a self-closing mechanism incorporating a different exemplary embodiment actuator.
Figure 7B:
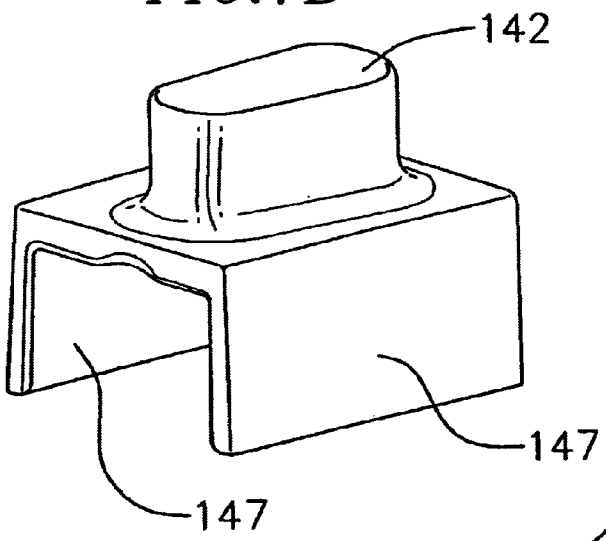
FIGS. 7B and 7C are a front and rear perspective views, respectively, of the actuator embodiment shown in FIG. 7A.
Figure 7C:
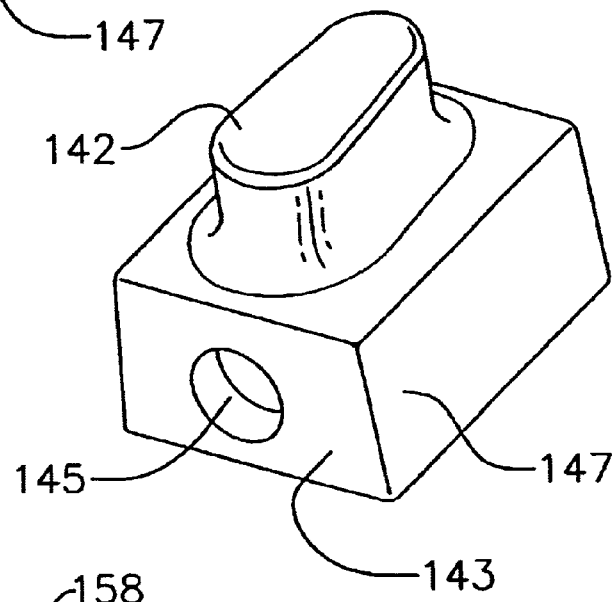

In another exemplary embodiment, the actuator guide member is an elongated protrusion 142 (FIGS. 7A, 7B and 7C). With this embodiment, the width 144 of the transverse portion 110 of the slot formed on the top wall of the housing should be wider than the width 146 of the longitudinal portion 92 of the slot to accommodate the increased length in the guide member. The longitudinal portion of the slot only has to accommodate the narrower width of the guide member. The increased length of the guide member protrusion provides more surface for engagement by the web slot of the inner member thereby reducing the force required to disengage the actuator guide member from the transverse edge 102 of the transverse slot 100 formed on the housing top wall. The increased length of the guide member also causes a reduction in the noise as the guide member moves across the web slot. This is due to the fact that the guide member, because of its increased length, will travel a smaller distance from one edge of the web slot before striking an opposite edge of the web slot. A front and rear perspective view of the guide member incorporated in the exemplary embodiment mechanism shown in FIG. 7A is shown in FIGS. 7B and 7C, respectively. This exemplary embodiment actuator comprises a rear wall 143 having an opening 145 for penetration by the guide pin 78. The opening 145 has a diameter greater than the diameter of the guide pin 78 but smaller than the diameter of the spring 86. The actuator also comprises two side walls 147 and no front wall. By coupling the guide pin to the actuator only via the rear wall, the actuator is allowed to pivot laterally relative to the guide pin such that central longitudinal axis of the opening 145 is offset relative to the central longitudinal axis of the guide pin. This allows the actuator to have more freedom of movement relative to the guide pin making the movement of the actuator and thus of the mechanism easier. In an alternate embodiment, not shown, the actuator may have a front wall with an opening for the guide pin and no rear wall.

Figure 7D:
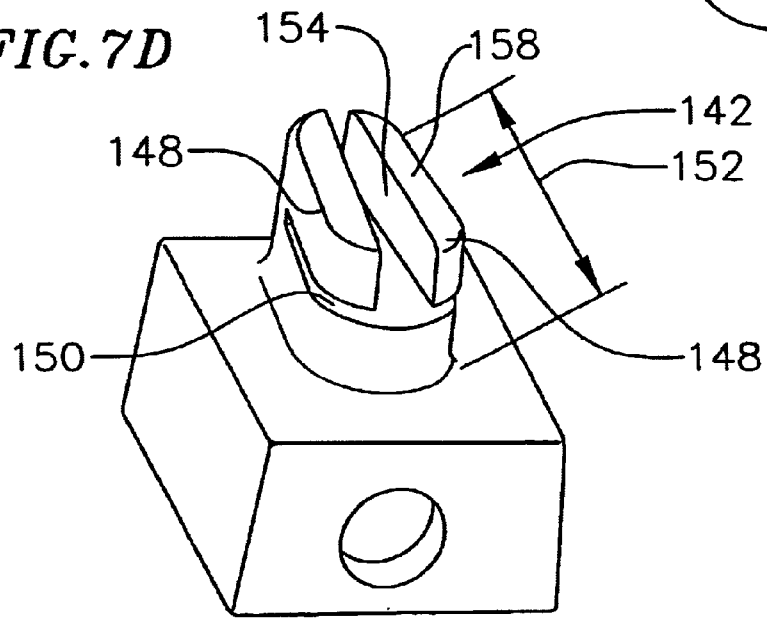
FIG. 7D is a perspective view of an alternate exemplary embodiment actuator.

In a further exemplary embodiment mechanism, an alternate embodiment actuator as shown in FIG. 7D is used. This embodiment guide member comprises an elongated protrusion 144 is made more flexible by having two flexible longitudinally extending members 148. These members may be formed by forming a slot 150 along a plane parallel to the upper surface of the protrusion that spans a portion of the length 152 of the protrusion and then forming a second slot 154 perpendicular to the first slot 150 extending to the upper surface 158 of the protrusion. The members which can flex reduce the impact noise when the actuator guide member is engaged by the web slot 109 of the slide inner member. In another exemplary embodiment, impact noise may be reduced by covering the actuator guide member, or at least the guide member protrusion, with a softer material, e.g., a rubbery material, cap.

Figure 8:
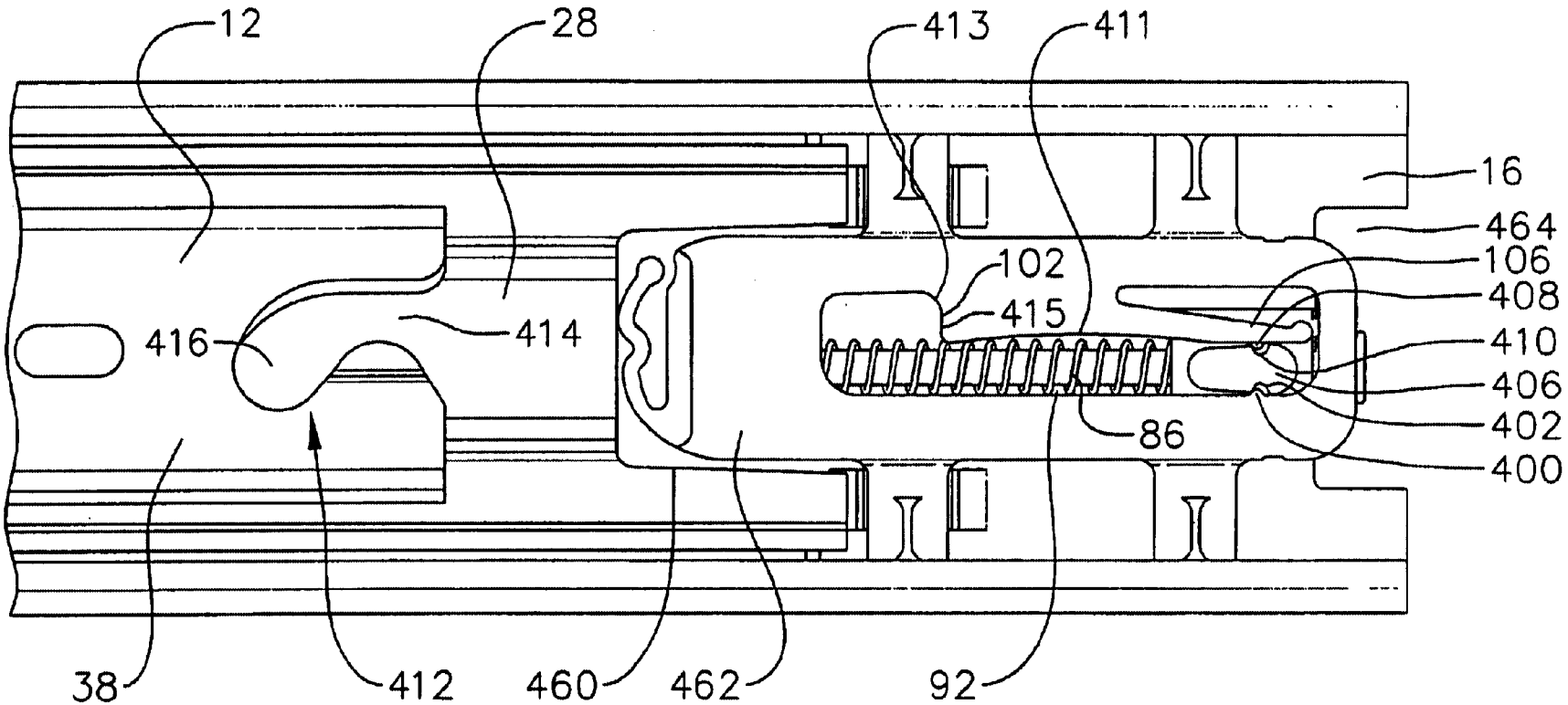
FIG. 8 is a partial top view of another exemplary embodiment three-member self-closing slide incorporating another exemplary embodiment self-closing mechanism of the present invention shown with its actuator in an unarmed state.

When an elongated protrusion forms the guide member, as for example the guide member 406 shown in FIG. 8 (or the guide member 142 shown in FIGS. 7C and 7D), a web slot 412 is formed on the web of the inner slide member having a first portion 414 extending from the rear end of the inner member web 38, and a second generally wider inclined slot portion 416 extending from the first portion. The second inclined portion is wider than the first portion to accommodate the elongated guide member.

In an alternate exemplary embodiment, as for example shown in FIG. 8, a bump or protrusion 400 is used in lieu of the detent 111. The bump 400 is formed on the edge of the longitudinal portion 92 of the slot 90 at a location opposite the tine 106 and extends within the slot portion 92. A complementary depression 402 is formed on the actuator guide member 406. When moving toward a closed position, i.e., rearward, the actuator guide member 406 is pushed sideways by the bump and in turns bends the tine 106. If the slide member with actuator guide member attempt to "bounce," i.e., to re-extend after closing, the bump 400 would engage the complementary depression 402 and suppress or stop the bounce, i.e., prevent slide extension. In yet a further alternate exemplary embodiment, a second bump 408 is formed on the tine 106 opposite the first bump 400. The second bump also extends into the longitudinal slot portion 92. A second depression 410 complementary to the second bump is formed on the actuator guide member 406 to accommodate the second bump.

In yet another exemplary embodiment, a ramp 415 may be formed on the transverse edge 102 of transverse portion 100 of the slot 90, as for example shown in FIG. 8, for aiding in the retention of the guide member in an "armed" state. The ramp may be defined by a bump 413 extending from the transverse edge 102. Moreover, in another exemplary embodiment, an edge 411 of the longitudinal portion 92 of the slot 90 may be slightly curved forming a concavity, as for example shown in FIG. 8, to avoid squeaking as the actuator guide member moves along the longitudinal slot portion. Squeaking typically occurs when a plastic member slides against another plastic member.

In a further alternate exemplary embodiment, instead of being coupled to the rear wall 52 of the housing, the guide pin 78 is coupled to the front wall 55 of the housing and is capable of pivoting relative to the front wall.

Figure 9A:
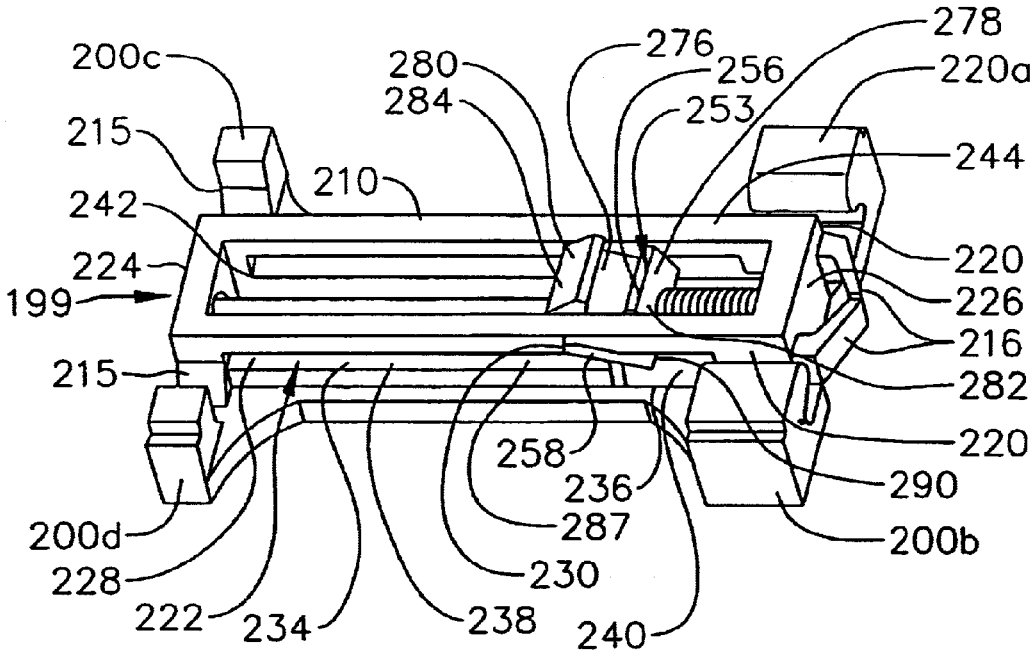
FIGS. 9A, 9B, 9C and 9D are a perspective view of a different exemplary embodiment self-closing mechanism of the present invention, a bottom view of such mechanism, a side view of such mechanism and end view of such mechanism.
Figure 9B:
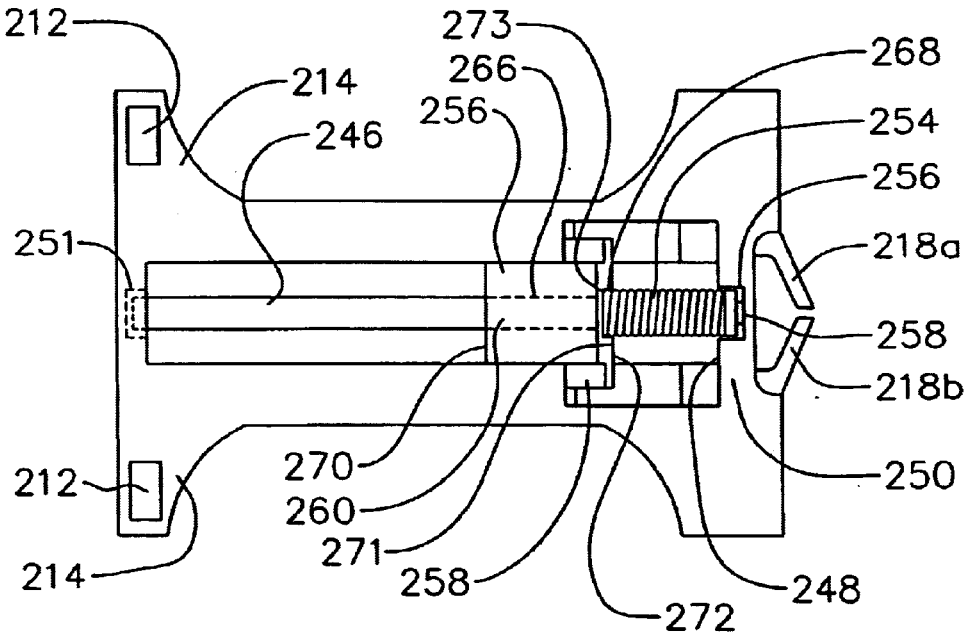
Figure 11:
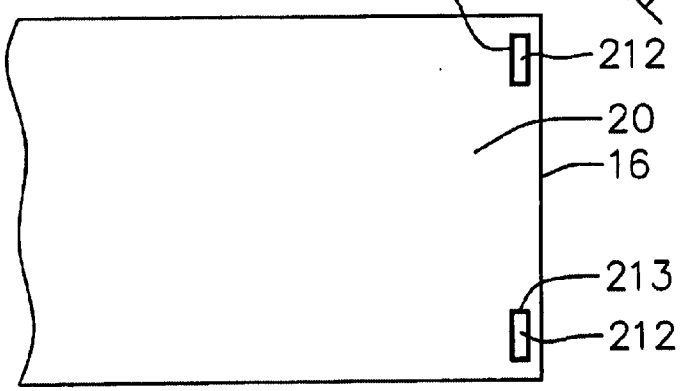
FIG. 11 is a partial bottom view of the self-closing slide shown in FIG. 10.

In an alternate exemplary embodiment self-closing mechanism shown in FIG. 9A, the housing or body 199 has four legs 200*a*, 200*b*, 200*c*, 200*d*, two extending from either side wall of the housing 210. With this embodiment, the legs have an outer surface complementary to the inner bearing raceways 26 of the slide outer member for snugly interfacing with the inner bearing raceways of the inner slide member. Preferably, at least two opposite legs have protrusions 212 extending from their lower surface 214 (FIG. 9B). These protrusions engage corresponding slots 213 formed on the web 20 of the outer member 16 for securing the housing to the outer member (FIG. 11).

The legs are preferably integrally formed with the housing. A groove 215 is formed through each leg to accommodate the legs 40 of the inner slide member 12 as shown in FIG. 9D. In this regard, the inner slide member can slide over the housing. Preferably the groove defines surfaces 217 on the legs to interface with the outer bearing raceways 42 of the inner slide member. In this regard, the grooves 215 serve as a guide for guiding the inner slide member over the housing.

Figure 10:
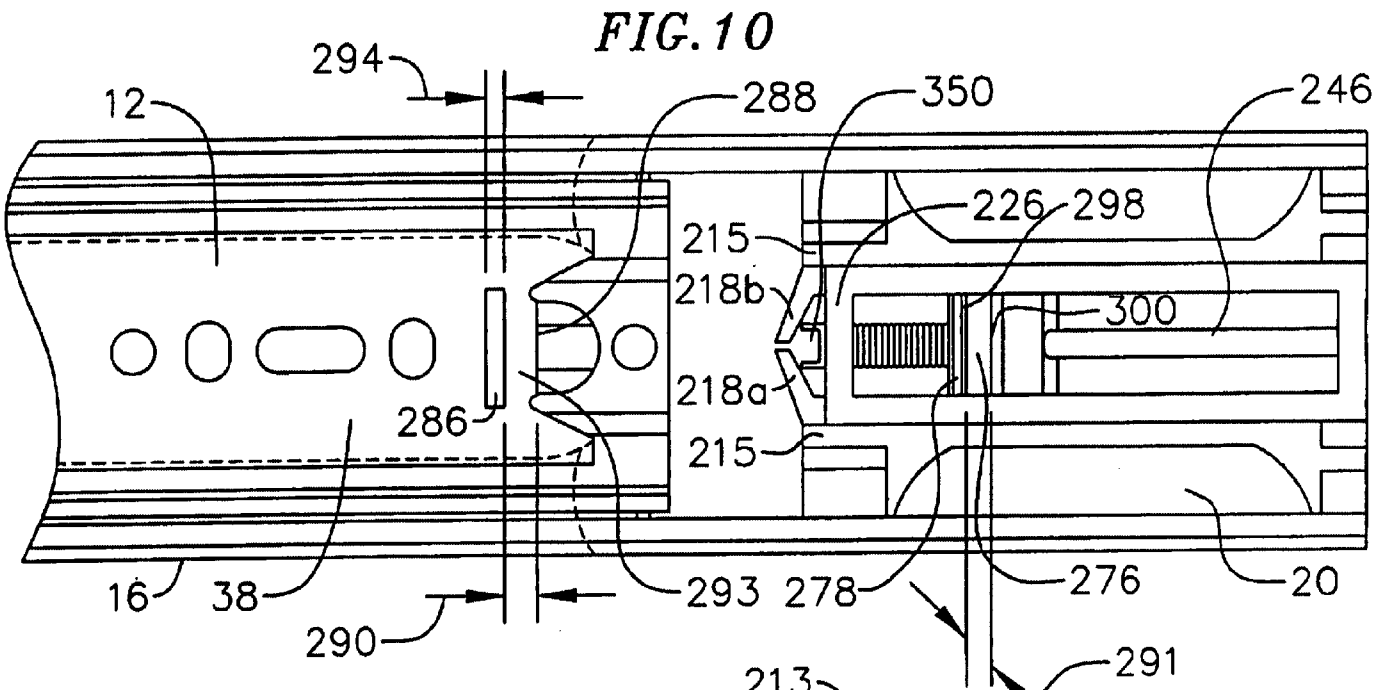
FIG. 10 is a partial top view of another exemplary embodiment three-member self-closing slide incorporating the self-closing mechanism depicted in FIG. 9A.

When the self-closing mechanism is incorporated in a three-member slide, as for example shown in FIG. 10, a stop 216 may extend from the front end of the mechanism housing. The stop may be in the form of a resilient member attached to the front end of the housing or may be in the form of two arms 218*a*, 218*b* as for example shown in FIGS. 9A and 9B, each arm extending from a side 220 of the housing toward the center of the housing which can flex as it is contacted by the intermediate member web 28, to absorb some of the energy due to impact, silence the impact and stop the movement of the intermediate member. Alternatively, the housing may be formed with a single arm as discussed above extending from the front end of the housing.

Figure 9C:
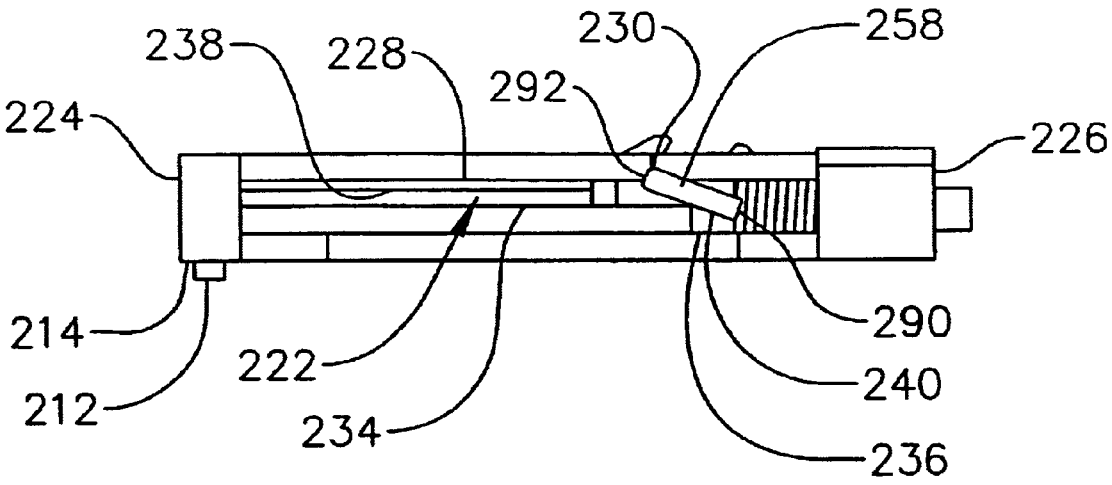
Figure 9D:
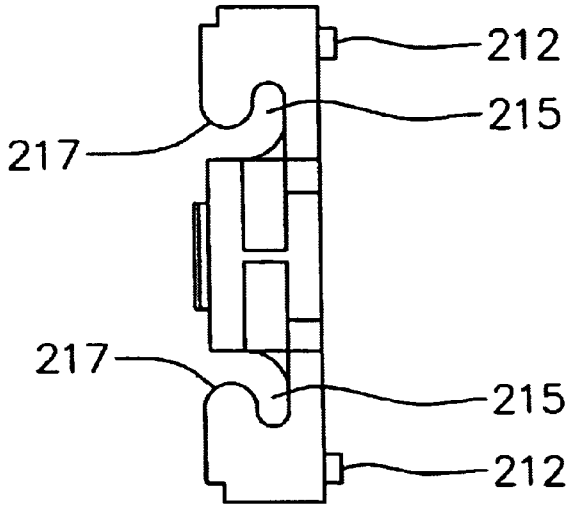

A guide slot 222 is formed in each of the two sidewalls 220 of the housing as shown in FIG. 9C. Each sidewall guide slot is a longitudinal slot extending from proximate the rear wall 224 of the housing to proximate to front end 226 of the housing. Each slot comprises an upper edge 228. The upper edge extends from proximate the rear wall of the housing to proximate the front wall of the housing. A notch 230 is formed on the upper edge nearer the front wall of the housing. A first lower edge 234 extends from proximate the rear wall of the housing to a location beyond the notch 230 where it is stepped down to a second lower edge 236. In other words, the second lower edge is lower than the first lower edge. Consequently, each slot has a narrow portion 238 which extends into a wider portion 240.

A longitudinal rectangular slot 242 is formed on the top wall 244 of the housing. A guide pin 246 extends from the inner surface 248 of the front wall 250 to the inner surface 252 of the rear wall 224 of the housing (FIG. 9B). A spring 254 surrounds the pin. In other words, the pin penetrates a spring. A groove 256 is formed on the inner surface 248 of the front wall 250 of the housing extending to the bottom of the front wall. The groove preferably has a flat base 258 and a width which is greater than the outer diameter of the spring. A groove 251 is formed on the inner surface of the rear wall 249. The groove extends from the top toward the bottom of the inner surface of the rear wall 224. Preferably, the groove is confined to an area within the middle of the wall and does not extend to the top or bottom ends of the rear wall. The groove 251 has a width slightly greater than the diameter of the guide pin 246.

The self-closing mechanism also comprises an actuator 253. The actuator comprises a body 256 having a tab 258 extending from either side of the body (FIG. 9B). The tabs have a thickness that is slightly smaller than the width of side wall slots narrower sections. An opening 260 is formed longitudinally through the body 256. The opening 260 is elongated in cross-section having a width 262 that is narrower than its height 264.

In one exemplary embodiment, the width 262 of the opening 260 is slightly larger than the diameter of the guide pin 246 but smaller than the outer surface diameter of the spring 254. In the exemplary embodiment shown in FIGS. 9B and 9C the opening is stepped from a first smaller width section 266 to a second larger width section 268 along the actuator body length. The first section 266 has a width greater than the diameter of the guide pin 246 but smaller than the outer surface diameter of the of the spring. The second section 268 has a width greater than the outer surface diameter of the spring. With this embodiment, the first section 266 extends from the rear end 270 of the body to a location 271 near the front end 272 of the actuator body 256. From there the second section 268 extends to the front end 272 of the actuator body. Consequently, an annular shoulder 273 is defined between the two sections.

A channel 276 bounded by a front lip 278 and a rear lip 280 is formed transversely across the upper surface of the actuator body 256. The front surface 282 of the front lip is tapered toward the channel. The rear surface 284 of the rear lip is preferably also tapered toward the channel.

To assemble the self-closing mechanism, the spring 254 is inserted over the guide pin 246, and the actuator 254 is placed over the guide pin from the rear end of the guide pin such that the guide pin penetrates the actuator opening 260. In the exemplary embodiment shown in FIGS. 9A and 9B where opening at the actuator front end 272 is wider than the outer surface diameter of the spring 254, the spring penetrates a portion of the actuator until it abuts the annular shoulder 273 in the actuator body. The guide pin rear end is fitted within the groove 251 formed on the inner surface of the rear wall and the guide pin forward end is fitted within the groove 256 formed on the inner surface of the front wall. The tabs 258 extending from the sides of the actuator are slidably fitted within the guide slots 222 on the side walls of the housing. While the housing may have a bottom wall, in the exemplary embodiment shown in FIGS. 9A and 9B, the housing does not have a bottom wall. The entire self closing mechanism is then mounted on the rear most end of the slide inner member such that the foot protrusions 212 protrude through corresponding slots 213 on the web 20 of the slide outer member as shown in FIG. 11.

When the pin is mounted within the housing, the rear end of the pin is elevated in comparison to the front end of the pin. This is caused by the relative positioning of the grooves 256 and 251 formed on the inner surfaces of the front and rear walls of the housing.

When the guide pin, spring and actuator are mounted within the housing, the spring urges the actuator toward the rear end of the housing. To move the actuator toward the forward end of the housing, a force must be applied on the actuator to move it against the spring force longitudinally forward. Because the pin and spring are inclined, i.e., the rear end of the pin is situated higher than the front end of the guide pin, as the tabs progress beyond the first lower edges 234 of the guide slots 222 and into the second lower edges 236 of the guide slots which are lower than the first lower edges, the actuator is caused to rotate in a forward direction such that forward ends 290 of the tabs rotate downward toward the second lower edges 236 of the guide slots while the rear end 292 of the tab engages the notch 230 formed on the upper edge of each of the guide slots 222. When in that position, the spring is in a compressed state and it attempting to urge the actuator toward the rear. However, the notch 230 formed in each of the guide slot upper edges provides a stop to such movement. Moreover, when in the rotated position, the front lip 278 of the actuator is in a lower position relative to the housing top wall while the actuator rear lip 280 is positioned higher relative to the housing top wall when compared to their positions prior to rotation.

The actuator is able to rotate partially relative to the guide pin 246 because of the actuator elongated opening 260 penetrated by the guide pin. Moreover, some actuator rotation is allowed by the relative available movement of the front and rear ends of the guide pin.

To interface with a self-closing mechanism, a web slot 286 is formed proximate the rear end 288 of the web 38 of the inner slide member 12 and is spaced apart from the rear end 288 of the web at a distance 290 that is shorter than the width 291 of the channel formed on the upper surface of the actuator (FIG. 10). Consequently, the strip 293 defined between the web slot and the end of the web has a width 290 that is shorter than the width of the channel 276 formed on the upper surface of the actuator. Furthermore, the web slot 286 has a width 294 which is slightly greater than the width of the front lip 278 of the actuator. In this regard, the slide inner member 12 can engage the actuator by having the strip 293 positioned within the channel such that the front lip 278 of the actuator penetrates the slot 286. Once the slide inner member has engaged the actuator, extension of the inner member applies a force against an inner surface 298 of the front lip of the actuator causing the actuator to travel forward against the spring force until the front ends 290 of the tabs 258 of the actuator moves past the first lower edges 234 of the guide slots 222, at which point the actuator rotates causing the front lip 278 to withdraw from the web slot 286 and release the inner slide member from the actuator. When that occurs, the actuator tab rear ends 292 remain engaged against the notch 230 formed on each upper edge 228 of the guide slots 222.

When the inner slide member is retracted moving rearward relative to the outer slide member, the rear end 288 of the web of the inner slide moves to engage an inner surface 300 of the rear lip 280 of the actuator such that the web strip 293 is positioned over the actuator channel 276. As the inner member continues to move rearward, it pushes against the inner surface 300 of the rear lip of the actuator, causing the actuator to rotate upward such that the actuator front lip 278 penetrates the web slot 286, while simultaneously causing the rear end 292 of each tab 258 to move downward and disengage from notch 230 causing the strip 293 to be straddled within the channel 276 between the front and rear lips of the actuator. When that occurs, the spring force urges the actuator backwards. Because the web strip 293 is straddled within the actuator channel, the actuator moves the slide rearward to self-close. The rear ends 292 of the tabs may be rounded to allow for easier disengagement from the notches 230, thereby requiring less force to disengage the tabs from the notches 230.

If the actuator were to inadvertently disengage from the slide inner member web 38, the mechanism provides for re-engagement of the actuator by the inner slide member web. In such case, as the inner member is retracted, i.e., moves backward relative to the slide outer member, the end 288 of the slide inner member web engages the front tapered surface 282 of the actuator front lip 278. The front lip front tapered surface 282 guides the rear end 288 of the web over the front lip 278 until the web strip 293 is positioned over the actuator channel at which time the actuator front lip 278 penetrates the web slot 286 and the web strip 293 is straddled within the actuator channel between the front and rear lips, thereby re-engaging with the inner slide member.

In another exemplary embodiment, ramp surfaces 287 may be formed extending from the first lower edges 234 of the side wall guide slots 222 inward, as for example shown in FIG. 9A. These ramp surfaces are co-extensive with the first lower edges. In other words, the ramp surfaces do not extend longitudinally beyond the first lower edges 234 of the side wall guide slots 222. The ramp surfaces provide support to for the actuator tabs 258. With this embodiment, the actuator tabs do not have to extend transversely to the first lower edges of the sidewall guide slots. They only have to extend to the ramps such that they are sandwiched between the ramp surfaces and the housing top wall. When the front ends 290 of the actuator move forward past the front end of the guide slot first lower edges, they move past the ramp surfaces 287 and are able to rotate forward as discussed above.

Figure 12A:
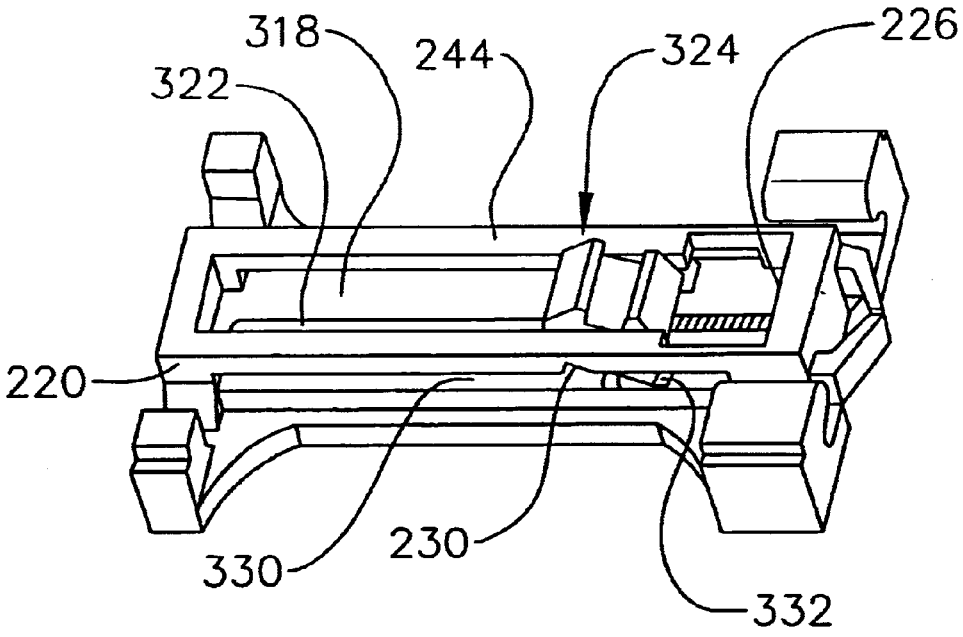
FIGS. 12A, 12B, 12C and 12D are a perspective view of a further alternate exemplary embodiment self-closing mechanism of the present invention, a bottom view of such mechanism, a side view of such mechanism, and a top view of such mechanism.
Figure 12B:
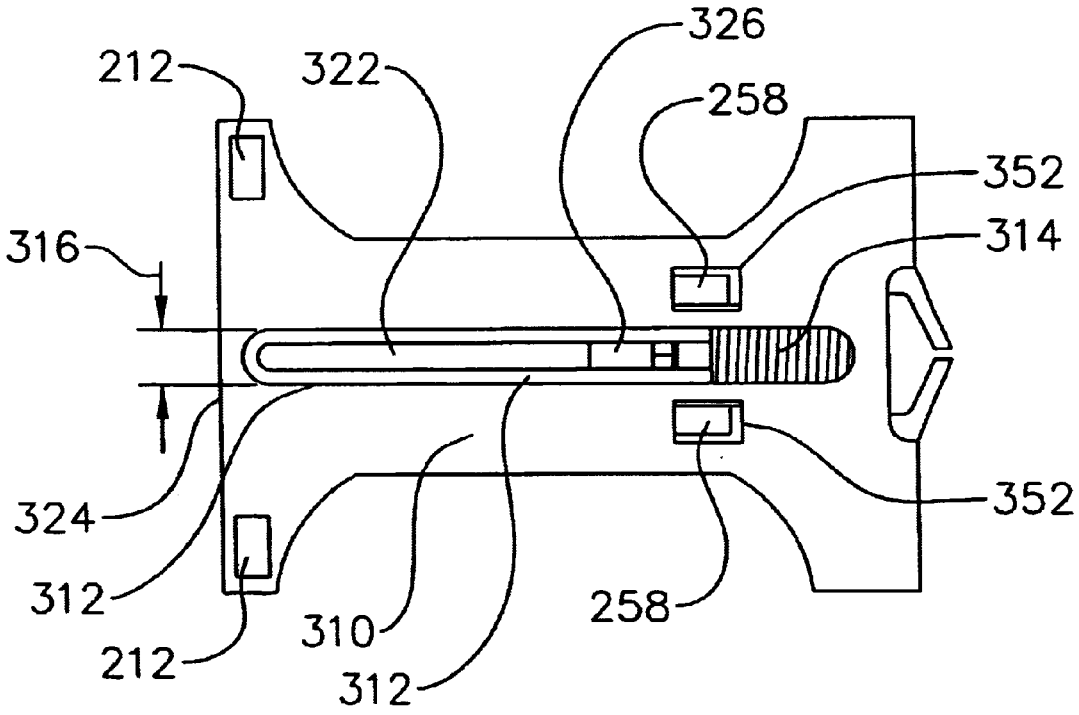
Figure 13A:
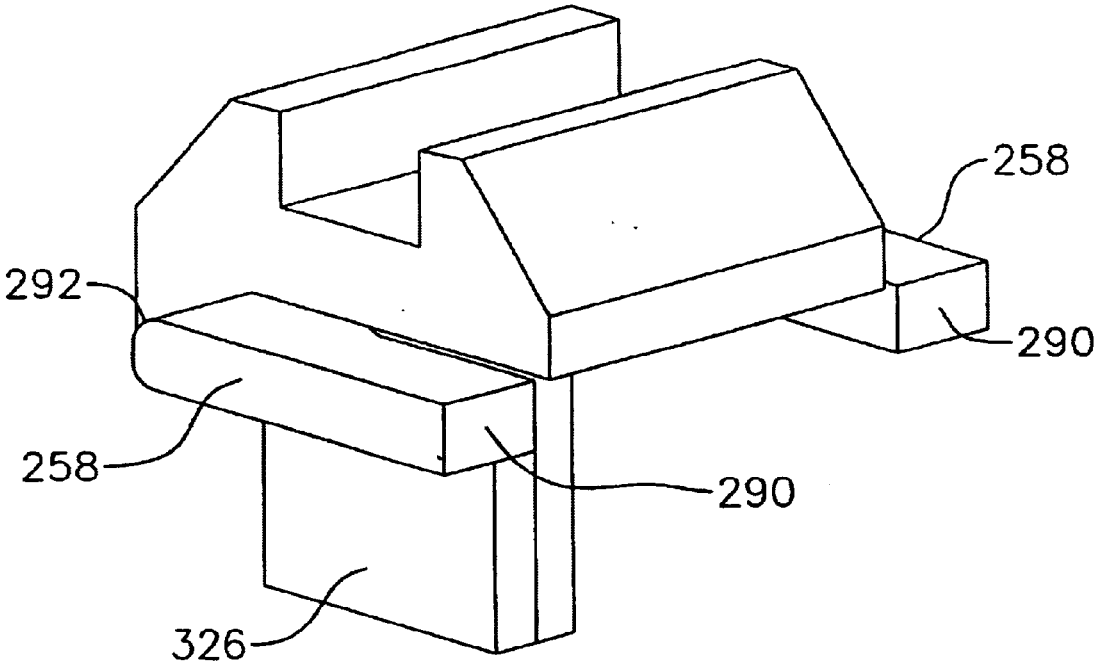
FIGS. 13A and 13B are a perspective and a side view, respectively, of an alternate exemplary embodiment actuator for use with the self-closing mechanism shown in FIG. 12A.
Figure 13B:
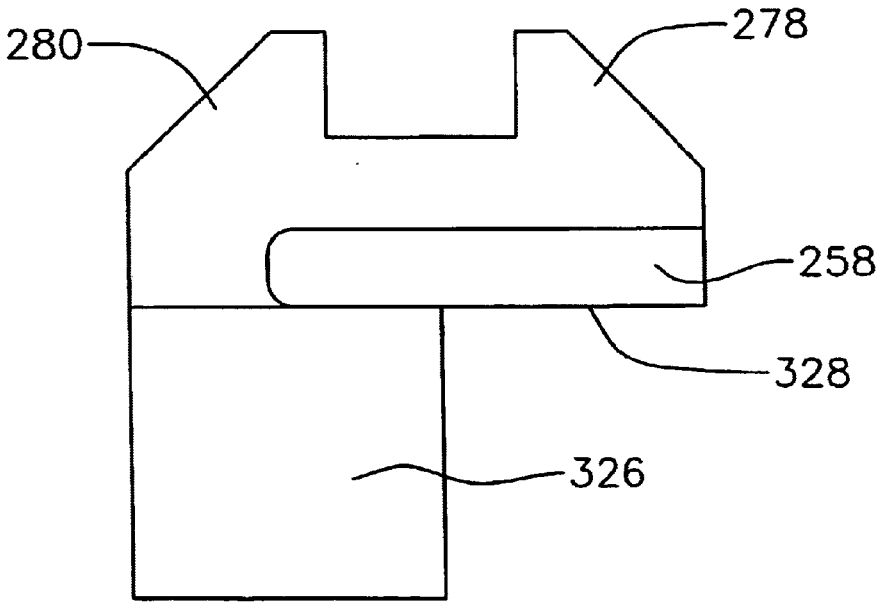

In an alternate exemplary embodiment shown in FIG. 12A, the guide pin is eliminated. With this embodiment, the housing is provided a bottom wall 310 (FIG. 12B). A central longitudinal slot 312 is formed along the bottom wall. A spring 314 is fitted within the central longitudinal slot. The slot has a width 316 slightly greater than the outer surface diameter of the spring. An intermediate wall 318 parallel to the bottom wall 310 is formed between the top wall 244 and bottom wall 310 of the housing. A central longitudinal guide slot 322 is formed along the intermediate wall. The guide slot 322 is parallel and axially aligned with the bottom wall slot 312. The actuator 324 is provided with a bottom tab 326 extending from a bottom surface 328 of the actuator proximate the rear of the actuator body (FIGS. 13A, 13B). The actuator also includes a pair of side tabs 258 extending from opposite sides of the actuator.

Figure 12C:
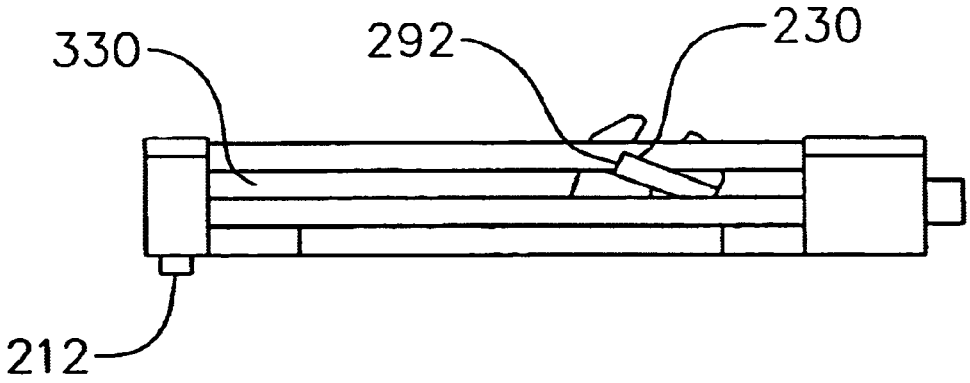
Figure 12D:
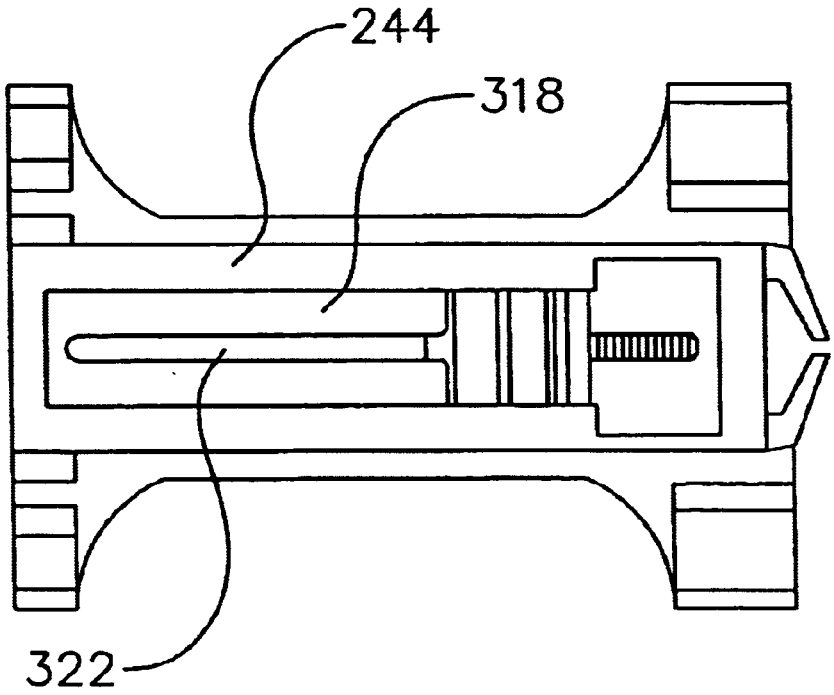

A guide slot 330 is formed on each sidewall 220 of the housing (FIGS. 12A, 12C). A notch 230 is also formed along the upper edge of each guide slot 330. Immediately forward of the notches a cutout 332 is formed across the intermediate wall.

Prior to mounting on the slide outer member 16, the actuator is fitted within the housing such that the side tabs 258 are slidably fitted within the sidewall guide slots 330 and the bottom tab is slidably fitted within the intermediate wall slot 312. The tab is moved toward the rear wall of the housing and the spring 314 is fitted within the bottom wall slot 322 between the front wall 226 and the actuator bottom tab 326. The thickness of the bottom wall is chosen to be sufficient for providing lateral support to the spring for preventing the spring from moving transversely across the housing. When the housing is mounted on the slide outer member 16, the outer member web 20 will retain the spring within the bottom wall slot 312.

When mounted on the slide outer member, the spring urges the bottom tab and thus the actuator toward the housing rear wall 224. When the slide inner member is engaged to the actuator and is extended relative to the outer member, the actuator is slid forward until it reaches the cutout 332 on the intermediate wall. When the actuator reaches the cutout, the off-center force which is applied by the spring to the actuator bottom tab causes the actuator to rotate forward and the rear ends 292 of the side tabs 258 to engage their corresponding notches 230 on the sidewall guide slots 330. Forward rotation of the actuator is aided by having the bottom tab 326 extending from proximate the rear portion of the actuator body.

When forward rotation of the actuator occurs, the inner slide member releases from the actuator and the force applied by the spring on the actuator bottom tab retains the actuator tabs and thus the actuator engaged to the notches 230 until it is re-engaged by the inner slide member and released from the notches. The rear ends 292 of the tabs may be rounded to allow for easier disengagement from the notches 230, thereby requiring less force to disengage the tabs from the notches 230.

The bottom wall of the housing 310 may be provided with a pair of actuator slots 352, one on either side of the bottom wall slot 312 for accommodating the side tabs 258 of the actuator when the actuator is in a rotated "armed" position (FIG. 12B).

With any of the embodiments of the present invention, the self-closing mechanism housing also provides lateral support to the slide inner member as it slides over the housing. Furthermore, any of the aforementioned housing may incorporate any of the legs described herein for mounting on the slide outer member. Moreover, a tab 350 may be cut from the web 20 of the slide outer member 16 for engaging the front wall 226 of the housing for further securing the housing to the slide outer member as shown for example in FIG. 10.

Figure 14A:
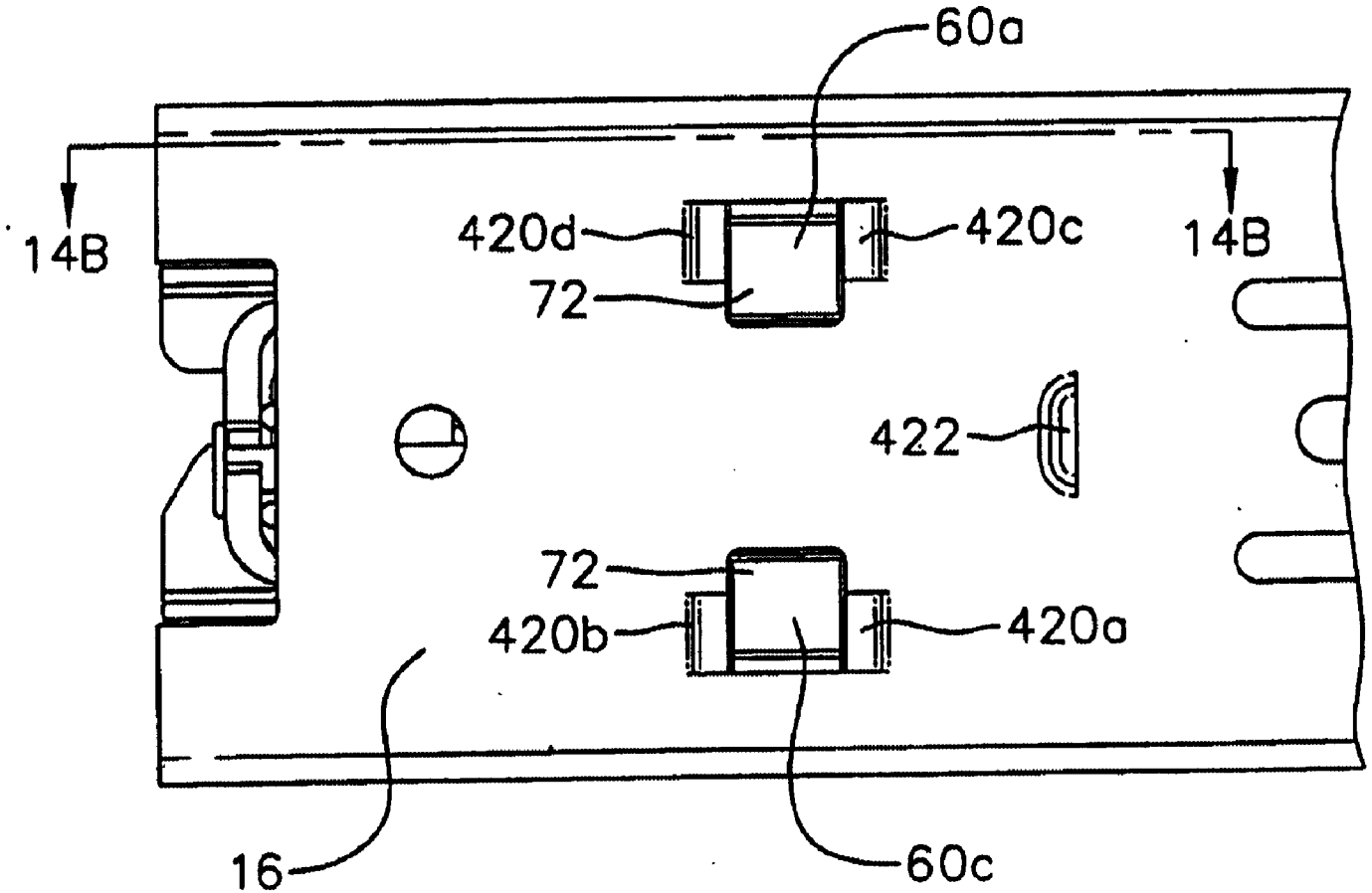
FIG. 14A is a partial bottom view of an exemplary embodiment self-closing slide incorporating an exemplary embodiment self-closing mechanism of the present invention.
Figure 14B:
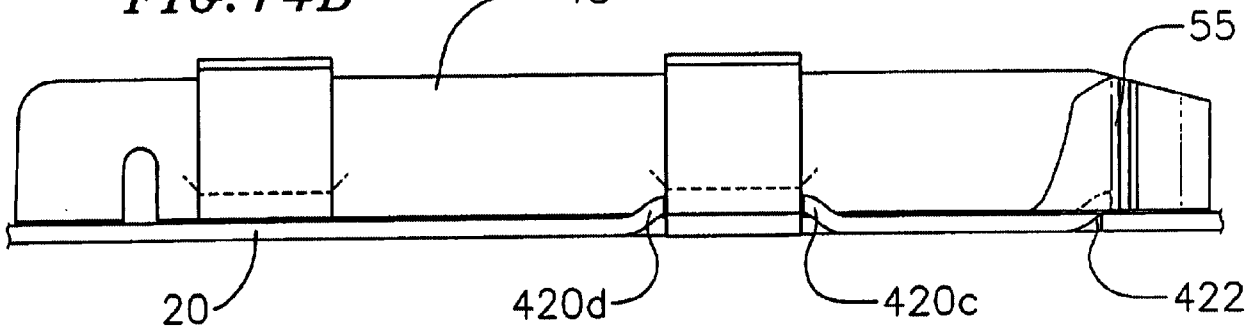
FIG. 14B is a partial side view taken along arrows 14B—14B of the self-closing slide shown in FIG. 14A.

With any of the aforementioned embodiments, the web portion of the slide web surrounding the legs of the housing may be lanced upwards. For example, as shown in FIGS. 14A and 14B, a portion of the slide web 20 immediately behind the housing legs 60*a* and 60*c* are raised i.e., lanced forming lances 420*d* and 420*b*, respectively. These lances provide further support to the housing and prevent the housing from sliding backward along the web 20 as the slide and actuator close. In yet a further alternate exemplary embodiment, the web 20 is lanced at a location for creating a lance 422 immediately behind the housing front wall 55. The lance 422 also provides support for preventing the housing from sliding backwards along the web 20 as the slide is closed. In another exemplary embodiment, the portions of the web in front of the legs are also lanced. For example, as shown in FIGS. 14A and 14B, lances 420*a* and 420*c* are formed in front of the housing legs 60*c* and 60*a*, respectively and opposite lances 420*b* and 420*d* respectively. Consequently a depression is defined between each pair of opposite lances, e.g., 420*a*, 420*b* and 420*c*, 420*d* for accommodating a leg of the housing. These depressions provide a predefined location for the legs to couple to the housing.

Figure 15:
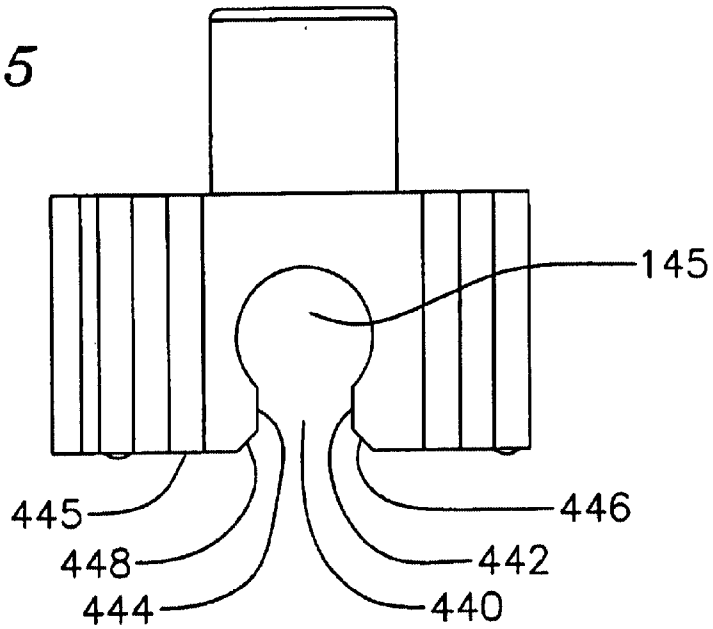
FIG. 15 is an end view of an alternate exemplary embodiment actuator of the present invention.

Moreover in any of the aforementioned exemplary embodiments incorporating a guide pin and an actuator, as for example the embodiments shown in FIGS. 3, 7A, 8, and 10, the actuator opening accommodating the guide pin, as for example the opening 145 formed on the wall 143 of the actuator as shown in FIG. 15, is extended to the free end 445 of the wall 143. In the exemplary embodiment shown in FIG. 15, the opening extends to the free end 445 of the wall via a slot 440 having a width that is smaller than the diameter of the opening. The width of the slot 440 should also be slightly smaller than the diameter of the guide pin. This allows for the actuator to "snap" on to the guide pin as for example guide pin 78. In other words, the guide pin "snaps" through the slot 440 into the opening 145. The slot 440 is defined between two edges 442, 444. These edges taper outward forming tapering edges 446, 448, respectively, at their intersection with the free end 445 of the wall increasing the width of the slot at the free end 445 of the wall. The tapering edges 446, 448 serve to guide the guide pin to the slot when the actuator is being "snapped" over the guide pin.

Figure 16:
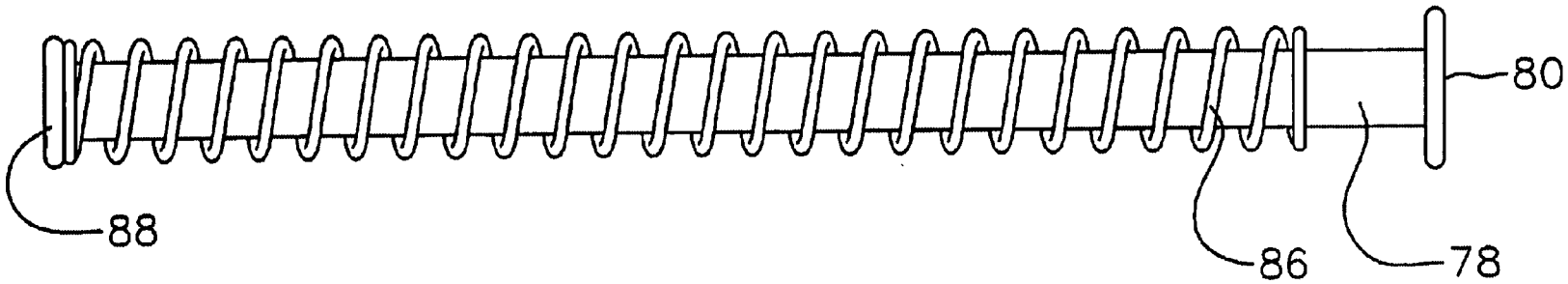
FIG. 16 is a top view of a spring surrounding a capped guide pin.
Figure 17:
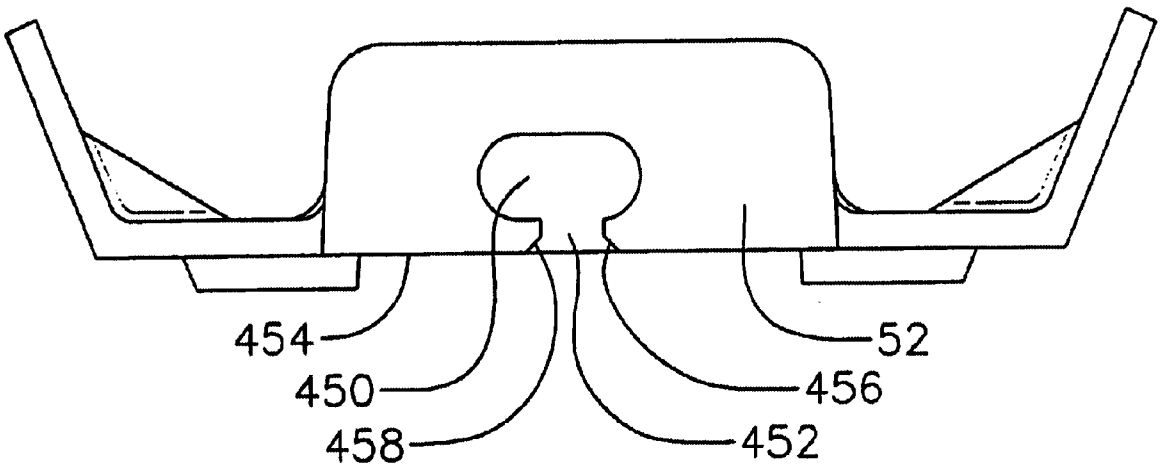
FIG. 17 is an end view of an exemplary housing for a self-closing mechanism of the present invention.

Further with any of the aforementioned embodiments incorporating a guide pin, as for example the embodiments shown in FIGS. 3, 7A, 8, and 10, the spring as for example spring 86 is fitted over the guide pin, as for example guide pin 78, and the guide pin is capped at both ends, e.g., a cap is formed at each end, as for example caps 80 and 88 shown in FIG. 16. One end of the guide pin may be capped prior to fitting the spring. If an actuator, as for example the actuator shown in FIG. 15 is used, the actuator may then be "snapped" on the guide pin. Alternatively, the pin may be fitted within the actuator prior to capping. The guide pin with spring and actuator may then be "snapped" onto a wall of the housing, as for example the housing rear wall. To allow for snapping of the pin onto the housing rear wall, the rear wall of the housing, as for example wall 52 shown in FIG. 17, is formed with an opening 450 which extends to the lower end 454 of the rear wall 52 via a slot 452 having a width that is smaller than the diameter of the opening 450. In the exemplary embodiment shown in FIG. 17, the opening 450 is has an elliptical shape whose minor diameter is greater than the guide pin diameter. The elliptical shape allows for the pin slide across the opening as well as pivot about the opening. The slot 450 width is slightly smaller than the diameter of the guide pin so as to allow the pin to "snap" through the slot and into the opening 450. Portion of the edges of the slot 452 extending to the lower end 454 taper outwards forming tapering edges 456, 458, increasing the width of the slot 452 to a dimension greater than the diameter of the guide pin. This increase in slot width provides a guide for guiding the guide pin to the slot 452 for being "snapped" in place.

In addition, when the mechanisms of the present invention are used with a three member slide, a longer intermediate slide member may be used by cutting out a portion of the web 28, forming a cut-out 460 to accommodate a front portion 462 of the self-closing mechanism as for example shown in FIG. 8. This would also allow use of longer ball bearing retainers and allow the slide to hold more weight.

Any of the self-closing mechanisms of the present invention may be mounted on a slide member such as the outer slide member 16 having a cut-out 464 as for example shown in FIG. 8 to allow the slide member to couple to a rear bracket (not shown).

With any of the aforementioned embodiments, the spring is preferably compressed when armed. In this regard, failure of the spring when armed would likely not cause the spring to eject from the mechanism as would occur if the spring were stretched during when armed as occurs with self-closing mechanisms using springs. Another advantage of the self-closing mechanism of the present invention is that they modular and can be easily incorporated into existing slides by slightly modifying the slide as for example, by forming a slot on the slide inner member web and by shortening the slide intermediate member if an intermediate member is used. Moreover, the mechanisms of the present invention do not require external tabs or other members to be connected to the slide to interface with the mechanism, which would be subject to early fatigue failures.

What is claimed is:

1. A self closing slide comprising:

first slide member;

a second slide member slidably coupled to the first slide member, the second slide member having a first end and a second end, wherein the first slide member can extend beyond the first end of the second slide member; and a self closing mechanism coupled to the second slide member, the self closing mechanism comprising, an elongated housing coupled to the second slide member proximate the second slide member second end, the housing having a first wall surrounded by at least a side wall, wherein the housing has a first end and a second end, wherein the housing second end is closer to the second slide member second end than the housing first end;

a spring located within the housing first and second ends, a longitudinal first slot formed on the housing first wall, and an actuator coupled to the spring and engageable by the first slide member, said actuator being slidable along the first slot between a first and a second position, and wherein first slide member slides over the housing first end.

2. A self closing slide as recited in claim 1 wherein the actuator comprises a channel extending from one end of the actuator to an opposite end of the actuator, wherein the said channel is oriented in a direction transverse to the first slot, and wherein said channel is bounded by an actuator first portion on one side and an actuator second portion on an opposite side.

3. A self closing slide as recited in claim 2 further comprising an opening formed on a web portion of the first slide member proximate an end of the first slide member, wherein a strip is defined between the opening and said end of the first slide member, wherein the first portion of the actuator penetrates the first slide member opening and wherein the strip is accommodated within the channel.

4. A self closing slide as recited in claim 3 wherein the actuator comprises a side tab extending from a side of the actuator, and wherein a side slot is formed on the side wall of the housing for accommodating the side tab, wherein the side tab slides along the side slot as the actuator moves along the housing, wherein the side slot comprises a first edge closer to the housing first wall and a second edge further from the housing first wall, the side slot having a width defined between the side slot first and second edges and wherein the width of the side slot increases proximate the housing first end and in a direction away from the housing first wall.

5. A self closing slide as recited in claim 4 further comprising a notch formed on the side slot first edge, wherein the side tab has a first end opposite a second end, wherein when in the first position, the side tab is at least partially within the increased width portion of the side slot, wherein the side tab and the actuator rotate to a position placing the side tab first end closer the to the side slot second edge, wherein the side tab second end engages the notch, and wherein the actuator first portion withdraws from the opening formed on the first slide member web portion.

6. A self closing slide as recited in claim 5 wherein the spring is in a compressed stated when the actuator is in the first position.

7. A self closing slide as recited in claim 4 wherein the actuator comprises a second side tab extending from a side of the actuator opposite the first side tab, and wherein a second side slot is formed on a second side wall of the housing for accommodating the second side tab, wherein the second side tab slides along the second side slot as the actuator moves along the housing, wherein the second side slot comprises a first edge closer to the housing first wall and a second edge further from the housing first wall, the second side slot having a width defined between the second side slot first and second edges and wherein the width of the second side slot increases proximate the housing first end and in a direction away from the housing first wall.

8. A self closing slide as recited in claim 4 further comprising a pin coupled to the housing and penetrating the spring and actuator, wherein the spring is sandwiched between the housing first end and the actuator.

9. A self closing slide as recited in claim 8 wherein the actuator comprises:

an actuator opening for accommodating the pin; and an actuator slot extending from the actuator opening to a free end of the actuator, wherein the pin has a diameter, wherein the actuator slot has a width smaller than the diameter, and wherein the pin is pushed into the actuator opening through the actuator slot.

10. A self closing slide as recited in claim 8, said housing wall comprising:

a wall opening for accommodating the pin; and a wall slot extending from the wall opening to a free end of the housing wall, wherein the pin has a diameter, wherein the wall slot has a width smaller than the diameter of the pin, and wherein the pin is pushed into the wall opening through the wall slot.

11. A self closing slide as recited in claim 8, said housing wall comprising:

a wall opening for accommodating the pin; and a wall slot extending from the wall opening to a free end of the housing wall, wherein the pin has a diameter, wherein the wall slot has a width smaller than the diameter of the pin, and wherein the pin is pushed into the wall opening through the wall slot.

12. A self closing slide as recited in claim 4 wherein the housing comprises a second side wall defining the first end of the housing and a third side wall defining the second end of the housing, and wherein a second end of the pin is fitted in a depression formed on the third side wall and wherein a first end of the pin is fitted within a groove formed on the second side wall, wherein the groove formed on the second side wall extends away from the first wall, wherein the pin can pivot about the third side wall such that the first end of the pin can move along the groove.

13. A self closing slide as recited in claim 4 further comprising:

a second wall spaced apart from the first wall;

a third wall between the first and second walls and spaced apart from the second and third walls;

a longitudinal slot formed through the third wall;

a longitudinal slot formed on the second wall to accommodate the spring; and a guide tab extending from the actuator and fitted within the third wall longitudinal slot.

14. A self-closing slide as recited in claim 13 wherein the second wall longitudinal slot penetrates the entire thickness of the second wall.

15. A self-closing slide as recited in claim 11 wherein the second wall slot has a width wider than the width of the spring.

16. A self-closing slide as recited in claim 13 wherein the spring is sandwiched between the guide tab and the first end of the housing.

17. A self closing slide as recited in claim 13 further comprising a notch formed on the side slot first edge, wherein the side tab has a first end opposite a second end, wherein when in the first position, the side tab is at least partially within the increased width portion of the side slot, wherein the side tab and thereby the actuator rotate placing the side tab first end closer the to the side slot second edge, wherein the side tab second end engages the notch, and wherein the actuator first portion withdraws from the first slide member opening.

18. A self closing slide as recited in claim 17 wherein the spring is in a compressed stated when the actuator is in the first position.

19. A self closing slide as recited in claim 13 wherein the actuator comprises a second side tab extending from a side of the actuator opposite the first side tab, and wherein a second side slot is formed on a second side wall of the housing for accommodating the second side tab, wherein the second side tab slides along the second side slot as the actuator moves along the body, wherein the second side slot comprises a first edge closer to the housing first wall and a second edge further from the housing first wall, the second side slot has a width defined between the second side slot first and second edges and wherein the width of the second side slot increases proximate the housing first end and in a direction away from the housing first wall.

20. A self closing slide as recited in claim 4 wherein the housing comprises a second side wall defining the first end of the of the housing and a third side wall defining the second end of the housing, and wherein a second end of the pin is fitted in a depression formed on the third side wall and wherein a first end of the pin is fitted within a groove formed on the second side wall, wherein the groove formed on the second side wall extends away from the first wall, wherein the pin can pivot about the third side wall such that the first end of the pin can move along the groove.

21. A self closing slide comprising:

a first slide member;

a second slide member slidably coupled to the first slide member;

a self closing mechanism coupled to the second slide member comprising a housing having an opening defined in the housing, a spring within the housing opening, and an actuator moveable in response to a force generated by the spring;

a slot formed on the first slide member; and a strip spanning across the slot formed on the first slide member, wherein at least a portion of said actuator is received within the slot, wherein the end of the first slide member is transverse to a longitudinal axis of the first slide member.

22. A self closing slide as recited in claim 21 wherein the actuator releasably engages the strip.

23. A self closing mechanism as recited in claim 21 wherein the strip is releasably straddled by the actuator.

24. A self closing slide comprising:

first slide member;

a second slide member slidably coupled to the first slide member, the second slide member having a first end and a second end, wherein the first slide member can extend beyond the first end of the second slide member; and a self closing mechanism coupled to the second slide member, the self closing mechanism comprising, an elongated housing coupled to the second slide member proximate the second slide member second end, the housing having a first wall surrounded by at least a side wall, wherein the housing has a first end and a second end, wherein the housing second end is closer to the second slide member second end than the housing first end;

a spring within the housing, a longitudinal first slot formed on the housing first wall, and an actuator coupled to the spring and engageable by the first slide member, said actuator being slidable along the first slot between a first and a second position and comprising a channel extending from one end of the actuator to an opposite end of the actuator, wherein the channel is oriented in a direction transverse to the first slot, and wherein said channel is bounded by an actuator first portion on one side and an actuator second portion on an opposite side.

25. A self closing slide as recited in claim 24 further comprising an opening formed on a web portion of the first slide member proximate an end of the first slide member, wherein a strip is defined between the opening and said end of the first slide member, wherein the first portion of the actuator penetrates the first slide member opening and wherein the strip is accommodated within the channel.

26. A self closing slide comprising:

first slide member;

a second slide member slidably coupled to the first slide member, the second slide member having a first end and a second end, wherein the first slide member can extend beyond the first end of the second slide member;

a self closing mechanism coupled to the second slide member, the self closing mechanism comprising, an elongated housing coupled to the second slide member proximate the second slide member second end, the housing having a first wall surrounded by at least a side wall, wherein the housing has a first end and a second end, wherein the housing second end is closer to the second slide member second end than the housing first end;

a spring within the housing, a longitudinal first slot formed on the housing first wall, and an actuator coupled to the spring and engageable by the first slide member, said actuator being slidable along the first slot between a first and a second position, wherein the actuator comprises a channel extending from one end of the actuator to an opposite end of the actuator, wherein the said channel is oriented in a direction transverse to the first slot, and wherein said channel is bounded by an actuator first portion on one side and an actuator second portion on an opposite side, and wherein the actuator comprises a side tab extending from a side of the actuator, and wherein a side slot is formed on the side wall of the housing for accommodating the side tab, wherein the side tab slides along the side slot as the actuator moves along the housing, wherein the side slot comprises a first edge closer to the housing first wall and a second edge further from the housing first wall, the side slot having a width defined between the side slot first and second edges and wherein the width of the side slot increases proximate the housing first end and in a direction away from the housing first wall; and an opening formed on a web portion of the first slide member proximate an end of the first slide member, wherein a strip is defined between the opening and said end of the first slide member, wherein the first portion of the actuator penetrates the first slide member opening and wherein the strip is accommodated within the channel.

27. A self closing slide as recited in claim 26 further comprising a notch formed on the side slot first edge, the side tab has a first end opposite a second end, wherein when in the first position, the side tab is at least partially within the increased width portion of the side slot, wherein the side tab and the actuator rotate to a position placing the side tab first end closer the to the side slot second edge, wherein the side tab second end engages the notch, and wherein the actuator first portion withdraws from the opening formed on the first slide member web portion.

28. A self closing slide as recited in claim 27 wherein the spring is in a compressed stated when the actuator is in the first position.

29. A self closing slide as recited in claim 26 wherein the actuator comprises a second side tab extending from a side of the actuator opposite the first side tab, and wherein a second side slot is formed on a second side wall of the housing for accommodating the second side tab, wherein the second side tab slides along the second side slot as the actuator moves along the housing, wherein the second side slot comprises a first edge closer to the housing first wall and a second edge further from the housing first wall, the second side slot having a width defined between the second side slot first and second edges and wherein the width of the second side slot increases proximate the housing first end and in a direction away from the housing first wall.

30. A self closing slide as recited in claim 26 further comprising a pin coupled to the housing and penetrating the spring and actuator, wherein the spring is sandwiched between the housing first end and the actuator.

31. A self closing slide as recited in claim 30 wherein the actuator comprises:

an actuator opening for accommodating the pin; and an actuator slot extending from the actuator opening to a free end of the actuator, wherein the pin has a diameter, wherein the actuator slot has a width smaller than the diameter, and wherein the pin is pushed into the actuator opening through the actuator slot.

32. A self closing slide comprising:

a first slide member;

a second slide member slidably coupled to the first slide member;

a self closing mechanism coupled to the second slide member comprising a housing, a spring within the housing and an actuator moveable in response to a force generated by the spring;

a slot formed on the first slide member and extending to an end of the first slide member; and a strip spanning across the slot formed on the first slide member, wherein at least a portion of said actuator is received within the slot, wherein the end of the first slide member is transverse to a longitudinal axis of the first slide member, and wherein the strip is releasably straddled by the actuator.

* * * * *